US011396181B2

(12) United States Patent
Hiramoto et al.

(10) Patent No.: US 11,396,181 B2
(45) Date of Patent: Jul. 26, 2022

(54) LIQUID EJECTING SYSTEM AND MAINTENANCE METHOD FOR LIQUID EJECTING SYSTEM

(71) Applicant: SEIKO EPSON CORPORATION, Tokyo (JP)

(72) Inventors: Goki Hiramoto, Azumino (JP); Saeko Maruyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/082,974

(22) Filed: Oct. 28, 2020

(65) Prior Publication Data

US 2021/0129538 A1 May 6, 2021

(30) Foreign Application Priority Data

Oct. 30, 2019 (JP) ..... JP2019-197252

(51) Int. Cl.
*B41J 2/165* (2006.01)
*B41J 29/17* (2006.01)

(52) U.S. Cl.
CPC ..... *B41J 2/16526* (2013.01); *B41J 29/17* (2013.01); *B41J 2002/16582* (2013.01)

(58) Field of Classification Search
CPC ..... B41J 2/165; B41J 2/1652; B41J 2002/16529; B41J 2002/16573
See application file for complete search history.

(56) References Cited

U.S. PATENT DOCUMENTS

2005/0078145 A1 4/2005 Inoue
2007/0057983 A1* 3/2007 Kawaguchi ..... B41J 2/16526 347/9
2007/0070167 A1 3/2007 Kojima
2011/0175957 A1 7/2011 Nishizaka
2011/0261096 A1 10/2011 Watanabe
2012/0262510 A1 10/2012 Komazawa et al.
2015/0239263 A1 8/2015 Ishizuka
2018/0086081 A1 3/2018 Sakamoto

FOREIGN PATENT DOCUMENTS

JP H05-147219 A 6/1993
JP 2003-291372 A 10/2003
JP 2004-130624 A 4/2004
JP 2005-119284 A 5/2005

(Continued)

*Primary Examiner* — Julian D Huffman
(74) *Attorney, Agent, or Firm* — Workman Nydegger

(57) ABSTRACT

A liquid ejecting system includes: a transport portion that transports a medium in a transport direction in a state in which the medium is supported on a medium supporting surface; a liquid ejecting portion that performs printing by moving in a scanning direction and ejecting a liquid from a nozzle with respect to the medium supported on the medium supporting surface; a designation portion for an operator to designate a designation range within a scanning area, the scanning area being configured to face the liquid ejecting portion that moves in the scanning direction and to include the medium and the medium supporting surface; and a control portion that sets a flushing area based on the designated designation range and performs a flushing operation of ejecting the liquid from the nozzle to the flushing area as a maintenance operation of the liquid ejecting portion.

10 Claims, 14 Drawing Sheets

(56) References Cited

FOREIGN PATENT DOCUMENTS

| | | | |
|---|---|---|---|
| JP | 2005-119294 | A | 5/2005 |
| JP | 2005-319650 | A | 11/2005 |
| JP | 2006-116808 | A | 5/2006 |
| JP | 2006-240232 | A | 9/2006 |
| JP | 2007-268826 | | 10/2007 |
| JP | 2009-056746 | A | 3/2009 |
| JP | 2009-148967 | A | 7/2009 |
| JP | 2011-143654 | A | 7/2011 |
| JP | 2011-206986 | A | 10/2011 |
| JP | 2012-218393 | A | 11/2012 |
| JP | 2014-008725 | A | 1/2014 |
| JP | 2015-157269 | A | 9/2015 |
| JP | 2015-202629 | A | 11/2015 |
| JP | 2016-172417 | A | 9/2016 |
| JP | 2018-051812 | A | 4/2018 |

* cited by examiner

LIQUID EJECTING SYSTEM AND MAINTENANCE METHOD FOR LIQUID EJECTING SYSTEM

The present application is based on, and claims priority from JP Application Serial Number 2019-197252, filed Oct. 30, 2019, the disclosure of which is hereby incorporated by reference herein in its entirety.

BACKGROUND

1. Technical Field

The present disclosure relates to a liquid ejecting system and a maintenance method for a liquid ejecting system.

2. Related Art

For example, as in JP-A-2015-202629, a printing apparatus is an example of a liquid ejecting system that performs printing by discharging an ink that is an example of a liquid from an ink jet head that is an example of a liquid ejecting portion. The ink jet head performs the printing by discharging the ink from a nozzle onto a recording medium that is an example of a medium transported by a transport belt. In the printing apparatus, the ink was ejected toward a flushing area on the transport belt in order to prevent clogging of the nozzle.

A flushing area is a predetermined area. Therefore, an operator's intention regarding a position for performing flushing was not reflected.

SUMMARY

A liquid ejecting system that solves the above problems includes: a transport portion that transports a medium in a transport direction in a state in which the medium is supported on a medium supporting surface; a liquid ejecting portion that performs printing by moving in a scanning direction and ejecting a liquid from a nozzle with respect to the medium supported on the medium supporting surface; a designation portion for an operator to designate a designation range within a scanning area, the scanning area being configured to face the liquid ejecting portion that moves in the scanning direction and to include the medium and the medium supporting surface; and a control portion that sets a flushing area based on the designated designation range and performs a flushing operation of ejecting the liquid from the nozzle to the flushing area as a maintenance operation of the liquid ejecting portion.

A maintenance method for a liquid ejecting system including: a transport portion that transports a medium in a transport direction in a state in which the medium is supported on a medium supporting surface; a liquid ejecting portion that moves in a scanning direction and ejects a liquid from a nozzle with respect to the medium supported on the medium supporting surface; and a designation portion for an operator to designate a designation range within a scanning area, the scanning area being configured to face the liquid ejecting portion that moves in the scanning direction and to include the medium and the medium supporting surface, the method including: setting a flushing area based on the designated designation range; and performing a flushing operation of ejecting the liquid from the nozzle to the flushing area as a maintenance operation of the liquid ejecting portion is provided.

DESCRIPTION OF EXEMPLARY EMBODIMENTS

Hereinafter, an embodiment of a liquid ejecting system and a maintenance method for the liquid ejecting system will be described with reference to the drawings. The liquid ejecting system is, for example, an ink jet printer that performs printing by ejecting a liquid such as an ink onto a medium such a cloth.

Figure 1:
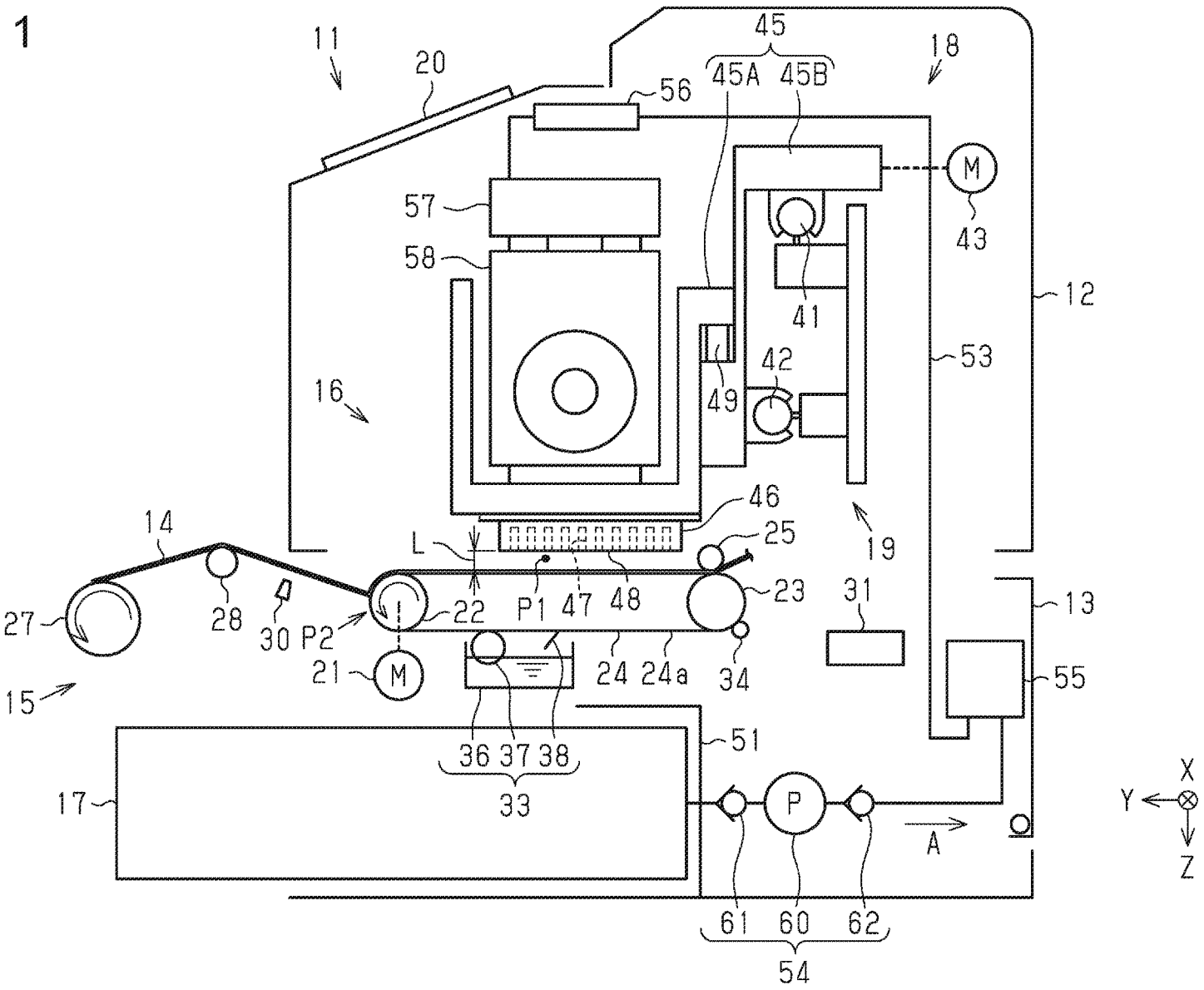
FIG. 1 is a schematic view illustrating a schematic configuration of a liquid ejecting system according to an embodiment.

As illustrated in FIG. 1, a liquid ejecting system 11 includes a housing 12 and a cover 13 that is attached to the housing 12 to be openable and closeable. The liquid ejecting system 11 includes a transport portion 15 that transports a medium 14, a liquid ejecting portion 16 that ejects a liquid to perform printing on the medium 14, a supply mechanism 18 that supplies a liquid accommodated in a liquid accommodating portion 17 to the liquid ejecting portion 16, and a movement mechanism 19 that moves the liquid ejecting portion 16. The liquid ejecting system 11 includes a designation portion 20 that enables an operator to designate setting related to the liquid ejecting system 11.

In the drawing, when the liquid ejecting system 11 is placed on a horizontal surface, the direction of gravity is indicated as a Z axis, and directions along a surface intersecting the Z axis are indicated as an X axis and a Y axis. It is preferable that the X axis, the Y axis, and the Z axis be perpendicular to each other, and the X axis and the Y axis are along the horizontal plane. In the present embodiment, the X axis direction is a width direction of the medium 14 and is a direction in which the liquid ejecting portion 16 moves. In the present embodiment, the Y axis direction is a direction in which the medium 14 is transported in a printing position P1 where the printing is performed on the medium 14. In the present embodiment, the Z axis direction is a direction in which the liquid ejecting portion 16 ejects the liquid. In the following description, the X axis direction is referred to as a scanning direction X, the Y axis direction is referred to as a transport direction Y, and the Z axis direction is referred to as a vertical direction Z.

Next, an embodiment of the transport portion 15 will be described.

The transport portion 15 includes a transport motor 21, a driving pulley 22 that rotates by driving of the transport motor 21, and a driven pulley 23 that is rotatable about an axial line parallel to an axial line of the driving pulley 22. The transport portion 15 includes an annular transport belt 24 hung between the driving pulley 22 and the driven pulley 23, and a pressing roller 25 that presses the medium 14 against the transport belt 24. The pressing roller 25 presses the medium 14 and the transport belt 24 against the driven pulley 23 to sandwich the medium 14 between the pressing roller 25 and the driven pulley 23.

An inner peripheral surface of the transport belt 24 is in contact with the driving pulley 22 and the driven pulley 23. An outer peripheral surface of the transport belt 24 is a medium supporting surface 24*a* that supports the medium 14. The transport belt 24 according to the present embodiment is an adhesive belt in which the medium supporting surface 24*a* is coated with an adhesive, and peelably adheres to and supports the medium 14. The transport belt 24 orbits around the driving pulley 22 and the driven pulley 23 as the transport motor 21 is driven, and transports the medium 14 in the transport direction Y in a state in which the medium 14 is supported on the medium supporting surface 24*a*.

The transport portion 15 includes a winding portion 27 that winds the printed medium 14 and a driven roller 28 located between the winding portion 27 and the transport belt 24. After being peeled off from the transport belt 24, the medium 14 transported by the transport belt 24 is wound on the winding portion 27 through the driven roller 28.

The liquid ejecting system 11 includes a peeling sensor 30 that detects the medium 14 peeled off from the transport belt 24 and a control portion 31 that totally controls driving of each mechanism such as the transport portion 15 and the liquid ejecting portion 16 in the liquid ejecting system 11. The peeling sensor 30 is provided at a position between the transport belt 24 and the driven roller 28, which is a position along a transport path of the medium 14. The peeling sensor 30 is, for example, an optical sensor including a light emitting portion and a light receiving portion, and detects a distance between the peeling sensor 30 and the medium 14 by irradiating a light beam from a direction intersecting a surface of the medium 14. The control portion 31 detects a peeling position P2 where the medium 14 is separated from the transport belt 24, based on a result of the detection by the peeling sensor 30. The control portion 31 controls driving of the winding portion 27 such that the peeling position P2 is located lower than the medium 14 located in the printing position P1 in the vertical direction Z.

The liquid ejecting system 11 includes a cleaning unit 33 for cleaning the transport belt 24 with a cleaning liquid and an absorption roller 34 that can absorb the cleaning liquid. The absorption roller 34 is a roller that can absorb a liquid at a portion in contact with the transport belt 24 and, for example, uses a cloth. The absorption roller 34 holds the transport belt 24 together with the driven pulley 23, and assists in removing the cleaning liquid and the liquid adhering to the transport belt 24. The cleaning unit 33 and the absorption roller 34 are provided to be movable between a position illustrated in FIG. 1 where the cleaning unit 33 and the absorption roller 34 come into contact with the transport belt 24 by driving a not-illustrated cleaning motor and a not-illustrated position where the cleaning unit 33 and the absorption roller 34 are separated from the transport belt 24.

The cleaning unit 33 includes a cleaning liquid accommodating portion 36 that accommodates the cleaning liquid, a cleaning brush 37 that comes into contact with the transport belt 24 to clean the transport belt 24, and a cleaning wiper 38 that removes the cleaning liquid and the liquid attached to the transport belt 24. The cleaning liquid is, for example, a liquid or water containing a detergent component such as a surfactant. The cleaning unit 33 may include a plurality of the cleaning wipers 38.

Next, an embodiment of the liquid ejecting portion 16 and the movement mechanism 19 will be described.

The movement mechanism 19 includes a first guide shaft 41 and a second guide shaft 42 in which the scanning direction X is set as the axial direction, and a carriage motor 43.

The liquid ejecting portion 16 includes a carriage 45 which can reciprocate along the first guide shaft 41 and the second guide shaft 42 and at least one liquid ejecting head 46 attached to a lower end portion of the carriage 45. In the present embodiment, four liquid ejecting heads 46 are attached in the carriage 45. The carriage motor 43 is a motor that moves the carriage 45.

Each of the liquid ejecting heads 46 has a nozzle surface 48 on which a plurality of nozzles 47 are formed. The liquid ejecting head 46 is provided such that the nozzle surface 48 faces the transport belt 24 or the medium 14 supported on the transport belt 24 in the vertical direction Z. The liquid ejecting portion 16 moves the medium 14 supported by the medium supporting surface 24*a* in the scanning direction X or a direction opposite to the scanning direction X, ejects the liquid from the plurality of nozzles 47, and performs printing on the medium 14.

The carriage 45 may include a carriage body 45A to which the liquid ejecting head 46 is attached and a carriage base 45B guided by the first guide shaft 41 and the second guide shaft 42. The liquid ejecting portion 16 may include an adjustment mechanism 49 that adjusts a position of the carriage body 45A with respect to the carriage base 45B. The adjustment mechanism 49 includes, for example, a cam or the like. The adjustment mechanism 49 causes the carriage body 45A to slide in the vertical direction Z or in a direction opposite to the vertical direction Z with respect to the carriage base 45B, and changes a distance L between the nozzle surface 48 and the medium supporting surface 24*a* in the vertical direction Z. The adjustment mechanism 49 may be operated by the operator or driving of the adjustment mechanism 49 may be controlled by the control portion 31.

Next, an embodiment of the supply mechanism 18 will be described.

The liquid ejecting system 11 includes a mounting portion 51 on which at least one liquid accommodating portion 17 is detachably mounted. The liquid ejecting system 11 may include a plurality of the supply mechanisms 18 according to the number of the liquid accommodating portions 17 that can be mounted on the mounting portion 51. In the present embodiment, four liquid accommodating portions 17 can be mounted on the mounting portion 51, and the liquid ejecting system 11 includes four supply mechanisms 18. Each of the supply mechanisms 18 supplies the liquid to the corresponding liquid ejecting head 46.

The plurality of liquid accommodating portions 17 accommodate different liquids, respectively. When the plurality of liquid accommodating portions 17 accommodate inks having different colors such as cyan, magenta, yellow, and black, the liquid ejecting portion 16 ejects inks having a plurality of colors, supplied from the liquid accommodating portion 17, to perform color printing on the medium 14. The liquid accommodating portion 17 may accommodate, for example, inks having colors such as light magenta, light cyan, light yellow, ash, orange, and white or may accommodate a moisturizing liquid or a cleaning liquid. Kinds of the liquids ejected by the liquid ejecting portion 16 may include, for example, three colors such as cyan, magenta, and yellow or may include one color such as black.

The supply mechanism 18 includes a supply path 53 through which the liquid is supplied from the liquid accommodating portion 17 mounted on the mounting portion 51 to the liquid ejecting head 46. The supply mechanism 18 causes the liquid to flow in the supply direction A from an upstream that is the liquid accommodating portion 17 side to a downstream that is the liquid ejecting head 46 side. A supply pump 54 that causes the liquid to flow, a filter unit 55 that captures air bubbles and foreign matters in the liquid, a static mixer 56 that changes flow of the liquid of the supply path 53 to stir the liquid, a liquid storing chamber 57 that stores the liquid, and a pressure adjusting unit 58 that adjusts a pressure of the liquid are provided in the supply path 53 in an order from an upstream of the supply direction A.

The supply pump 54 has a diaphragm pump 60, the volume of a pump chamber of which is varied, a suction valve 61 disposed between the diaphragm pump 60 and the liquid accommodating portion 17, and a discharge valve 62 disposed between the diaphragm pump 60 and the filter unit 55. The suction valve 61 and the discharge valve 62 are one-way valves that allow flow of the liquid from the upstream to the downstream and block flow of the liquid from the downstream to the upstream. The supply pump 54 suctions the liquid from the liquid accommodating portion 17 through the suction valve 61 as the volume of the pump chamber of the diaphragm pump 60 increases, and discharges the liquid toward the liquid ejecting head 46 through the discharge valve 62 as the volume of the pump chamber decreases.

The filter unit 55 is mounted detachably with respect to the supply path 53. The filter unit 55 is disposed at a position corresponding to the cover 13 and can be replaced by opening the cover 13.

Figure 2:
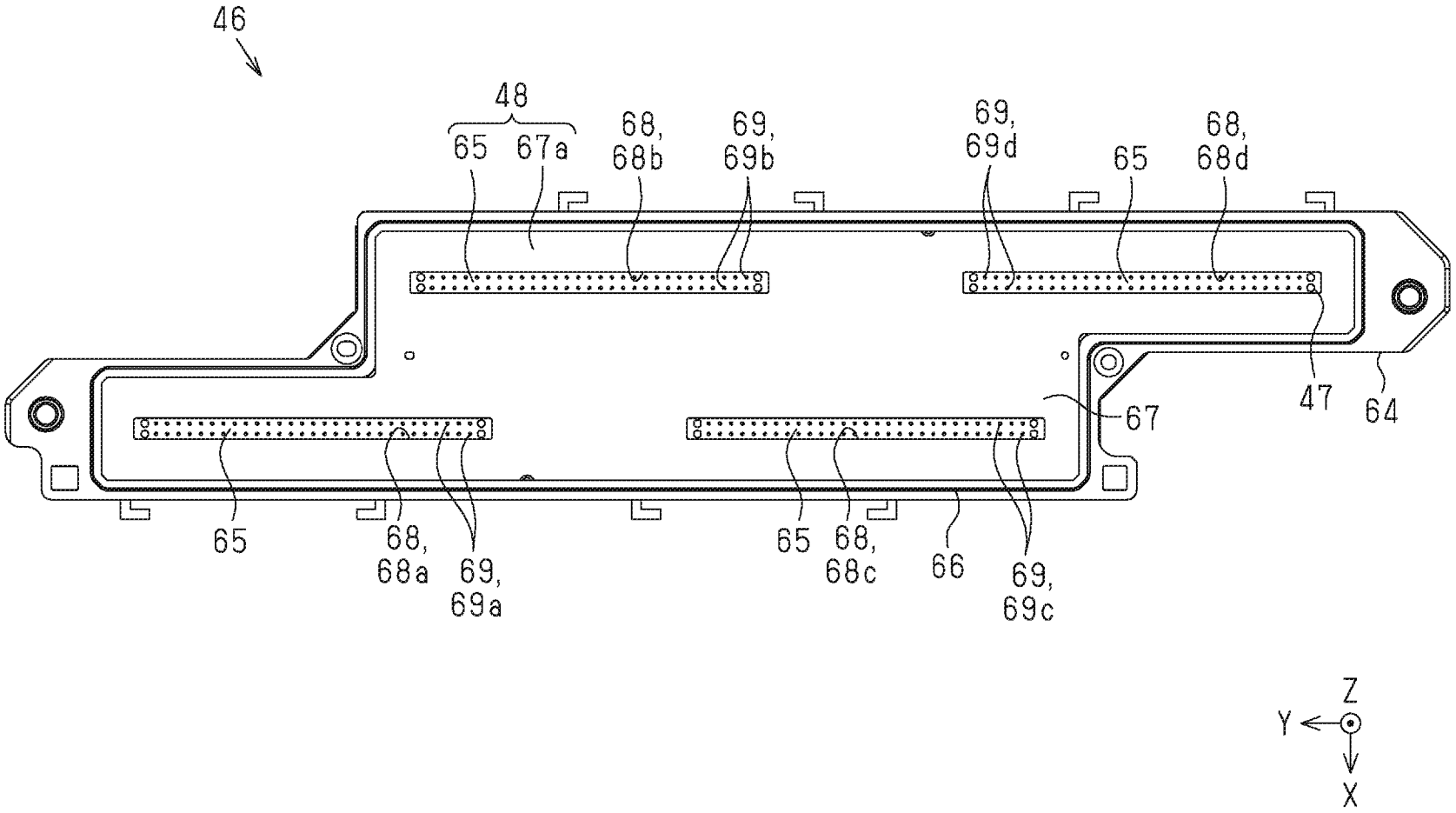
FIG. 2 is a bottom view illustrating a liquid ejecting head.

As illustrated in FIG. 2, the liquid ejecting head 46 includes a bracket 64 for attaching the liquid ejecting head 46 to the carriage 45, a head body 66 having a nozzle opening surface 65 on which the plurality of nozzles 47 are opened, and a plate 67 that covers a part of the nozzle opening surface 65.

The plate 67 is, for example, made of metal such as stainless steel, and is shaped such that two rectangular shapes in which the transport direction Y is set as a lengthwise direction when viewed from the lower side are misaligned in the transport direction Y. At least one through-hole 68 is formed in the plate 67. In the present embodiment, a first through-hole 68*a* to a fourth through-hole 68*d* constituting a rectangular shape that is long in the transport direction Y are formed in the plate 67. The plate 67 is fixed to the head body 66 such that the nozzles 47 are exposed from the through-holes 68. The nozzle surface 48 is configured with the nozzle opening surface 65 exposed from the through-holes 68 and a lower surface 67*a* of the plate 67.

The plurality of through-holes 68 are formed to be shifted in the transport direction Y. The through-holes 68 are defined as the first through-hole 68*a*, a second through-hole 68*b*, a third through-hole 68*c*, and the fourth through-hole 68*d* in an order from the downstream in the transport direction Y. The second through-hole 68*b* is located at an intermediate position between the first through-hole 68*a* and the third through-hole 68*c* in the transport direction Y. The third through-hole 68*c* is located at an intermediate position between the second through-hole 68*b* and the fourth through-hole 68*d* in the transport direction Y.

The first through-hole 68*a* and the third through-hole 68*c* are located at the same position in the scanning direction X to be spaced apart from each other in the transport direction Y. The second through-hole 68*b* and the fourth through-hole 68*d* are located at the same position in the scanning direction X to be spaced apart from each other in the transport direction Y. In the scanning direction X, the first through-hole 68*a* and the third through-hole 68*c* are located in positions that are different from the position of the second through-hole 68*b* and the fourth through-hole 68*d* to be spaced apart from the second through-hole 68*b* and the fourth through-hole 68*d*, respectively.

The liquid ejecting head 46 has a first nozzle group 69*a* to a fourth nozzle group 69*d* each having a large number of the nozzles 47 arranged at a constant pitch in the transport direction Y. The first nozzle group 69*a* is exposed from the first through-hole 68*a*, the second nozzle group 69*b* is exposed from the second through-hole 68*b*, the third nozzle group 69*c* is exposed from the third through-hole 68*c*, and the fourth nozzle group 69*d* is exposed from the fourth through-hole 68*d*. The first nozzle group 69*a* and the third nozzle group 69*c* are formed at the same position in the scanning direction X and are arranged in a row in the transport direction Y. The second nozzle group 69*b* and the fourth nozzle group 69*d* are formed at the same position in the scanning direction X and are arranged in a row in the transport direction Y.

A part of the first nozzle group 69*a* and a part of the second nozzle group 69*b*, a part of the second nozzle group 69*b* and a part of the third nozzle group 69*c*, and a part of the third nozzle group 69*c* and a part of the fourth nozzle group 69*d* overlap each other when viewed from the scanning direction X. That is, the first nozzle group 69*a* to the fourth nozzle group 69*d* constitute a nozzle row 69 continuing in the transport direction Y when viewed from the scanning direction X. One nozzle row 69 ejects the same kind of liquid. A plurality of the nozzle rows 69 may be formed in the liquid ejecting head 46.

Figure 3:
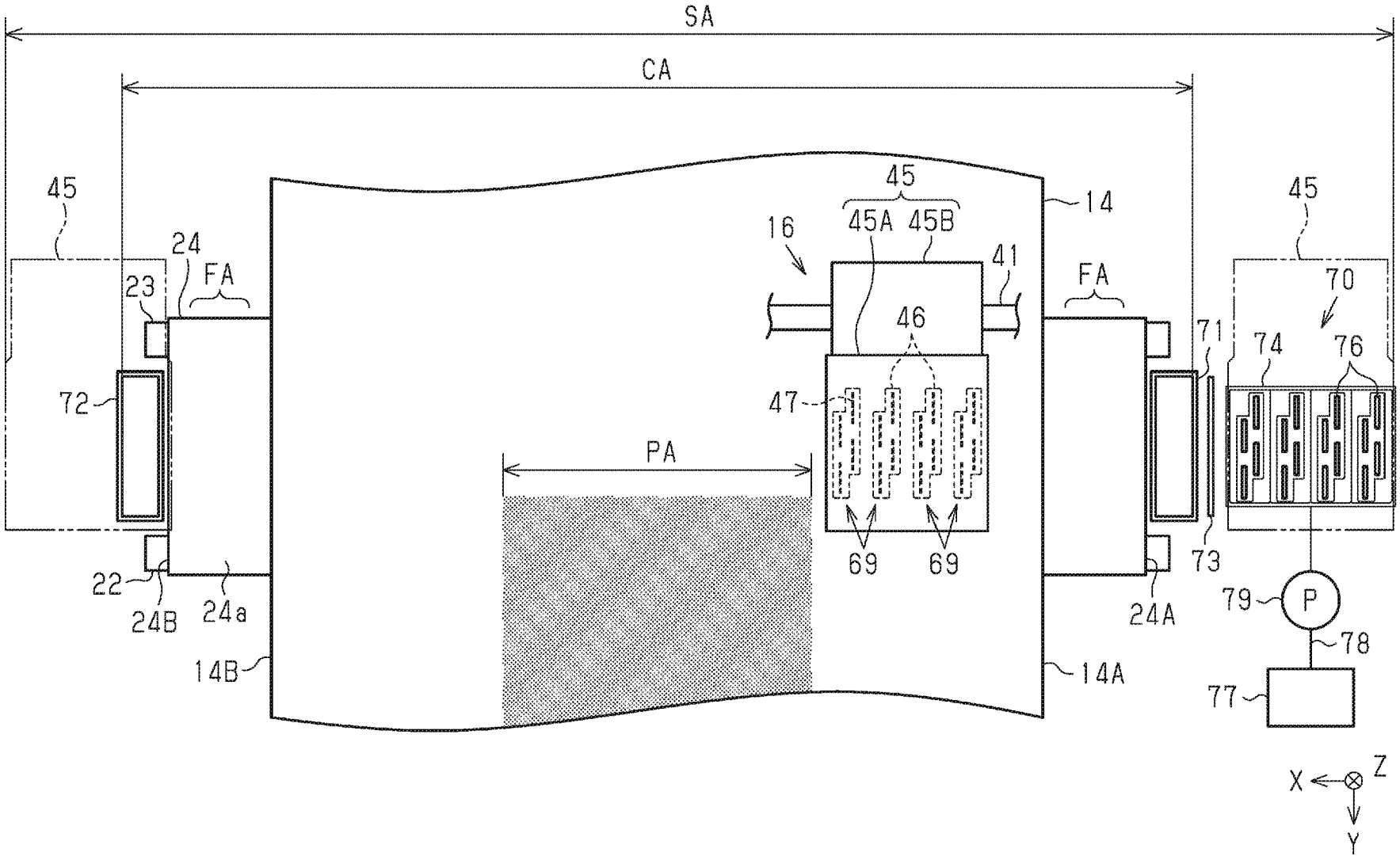
FIG. 3 is a schematic plan view illustrating a transport belt that transports a medium and a maintenance mechanism.

As illustrated in FIG. 3, four liquid ejecting heads 46 are arranged in parallel to each other at a constant pitch in the scanning direction X. Configurations of the liquid ejecting heads 46 are the same. Therefore, the plurality of nozzle rows 69 are arranged in parallel to each other at a constant pitch in the scanning direction X. That is, the plurality of nozzles 47 are arranged on the nozzle surface 48 to form the plurality of nozzle rows 69 arranged in the scanning direction X. A plurality of different kinds of liquids can be ejected from the plurality of nozzle rows 69.

The liquid ejecting system 11 includes a maintenance mechanism 70 for performing maintenance of the liquid ejecting portion 16. The maintenance mechanism 70 maintains the liquid ejecting portion 16 to prevent or resolve ejection failure caused by the clogging of the nozzles 47, mixing of air bubbles into the liquid ejecting head 46, attachment of the foreign matters to the peripheries of the nozzles 47, and the like.

The maintenance mechanism 70 includes a first flushing tray 71 and a second flushing tray 72 that receive the liquid ejected from the liquid ejecting head 46, a cleaning member 73 that wipes and cleans the nozzle surface 48, and a cleaning mechanism 74 that cleans the liquid ejecting head 46. The first flushing tray 71 and the second flushing tray 72 may be provided at positions on both sides of the transport belt 24 in the scanning direction X so as to be adjacent to the transport belt 24. The first flushing tray 71 is provided between the cleaning member 73 and the transport belt 24 in the scanning direction X. The second flushing tray 72 is provided opposite to the cleaning member 73 and the cleaning mechanism 74 with the transport belt 24 interposed therebetween.

When the printing is not performed or when power is turned off, the liquid ejecting portion 16 stands by at a home position where the cleaning mechanism 74 is disposed. When performing the printing, the liquid ejecting portion 16 alternately moves in the scanning direction X away from the home position and in a direction opposite to the scanning direction X, and ejects the liquid onto a printing area PA to perform the printing. An area that can face the liquid ejecting portion 16 that moves in the scanning direction X is referred to as a scanning area SA. The scanning area SA includes the medium 14 and the medium supporting surface 24*a*. The maintenance mechanism 70 is provided in the scanning area SA.

As a maintenance operation of the liquid ejecting portion 16, the control portion 31 performs a flushing operation of ejecting the liquid from the nozzle 47 to the flushing area FA. The flushing area FA may be set on any of the first flushing tray 71, the second flushing tray 72, the transport belt 24, and the medium 14. The control portion 31 may set the flushing areas FA on both sides of the printing area PA in the scanning direction X.

An area of the scanning area SA that can be set as the flushing area FA is referred to as a setting area CA. The setting area CA includes the first flushing tray 71, the second flushing tray 72, and an area between the first flushing tray 71 and the second flushing tray 72.

The flushing operation is an operation of ejecting and discharging the liquid from the nozzle 47 separately from ejection of the liquid onto the medium 14 to be printed, in order to prevent or resolve clogging of the nozzles 47. Foreign matters, air bubbles, and altered liquids, which cause ejection failure, can be discharged through the flushing operation. An example of the altered liquids is thickened ink. The flushing operation is executed to resolve a slight ejection failure.

The cleaning member 73 performs a wiping operation of wiping the nozzle surface 48 as the maintenance operation of the liquid ejecting head 46. The cleaning member 73 is formed of an elastic member such as rubber or resin elastomer and is formed in a thin plate shape. At least one of the cleaning member 73 and the liquid ejecting head 46 is configured to relatively move in the vertical direction Z between a wiping position where the cleaning member 73 and the nozzle surface 48 can come into contact with each other and a retracted position where the cleaning member 73 is separated from the nozzle surface 48 in the vertical direction Z. When the liquid ejecting head 46 moves in the scanning direction X and passes through the cleaning member 73 while being located in the wiping position, the cleaning member 73 and the liquid ejecting head 46 come into contact with the nozzle surface 48 to wipe the nozzle surface 48 while the cleaning member 73 is elastically deformed. That is, the cleaning member 73 moves relatively to the liquid ejecting portion 16 in the scanning direction X along the nozzle surface 48 to wipe the nozzle surface 48.

The cleaning mechanism 74 includes a suction cap 76, a suction tube 78 that connects the suction cap 76 and a waste liquid accommodating portion 77, and a suction pump 79 that sucks an inside of the suction cap 76. The suction pump 79 is, for example, a tube pump provided in the middle of the suction tube 78. At least one of the suction cap 76 and the liquid ejecting head 46 is configured to relatively move between a capping position in which a space where the nozzles 47 are opened is a closed space and a retracted position where the space where the nozzles 47 are opened is an opened space. The suction cap 76 and the liquid ejecting head 46 are disposed in the capping position so that capping is performed.

The suction cap 76 comes into contact with the liquid ejecting head 46 to form a closed space covering all the nozzles 47 at once. The cleaning mechanism 74 performs a cleaning operation as the maintenance operation of the liquid ejecting head 46, in which the suction pump 79 is driven to apply a negative pressure to the closed space formed by disposing the suction cap 76 at the capping position, so that the liquid is sucked from the nozzles 47.

The medium supporting surface 24*a* can support the medium 14 at a predetermined position in the scanning direction X. For example, the medium supporting surface 24*a* may support the medium 14 arranged at the center in the scanning direction X or may support the medium 14 arranged close to an end of the transport belt 24.

In the present embodiment, among ends of the medium 14 in the scanning direction X, an end closer to the home position is called a first medium end 14A, and an end away from the home position is called a second medium end 14B. Among ends of the transport belt 24 in the scanning direction X, an end closer to the home position is called a first belt end 24A, and an end away from the home position is called a second belt end 24B. The first belt end 24A is an end adjacent to the first flushing tray 71, and is located between the first flushing tray 71 and the first medium end 14A in the scanning direction X. The second belt end 24B is an end adjacent to the second flushing tray 72, and is located between the second medium end 14B and the second flushing tray 72 in the scanning direction X.

Figure 4:
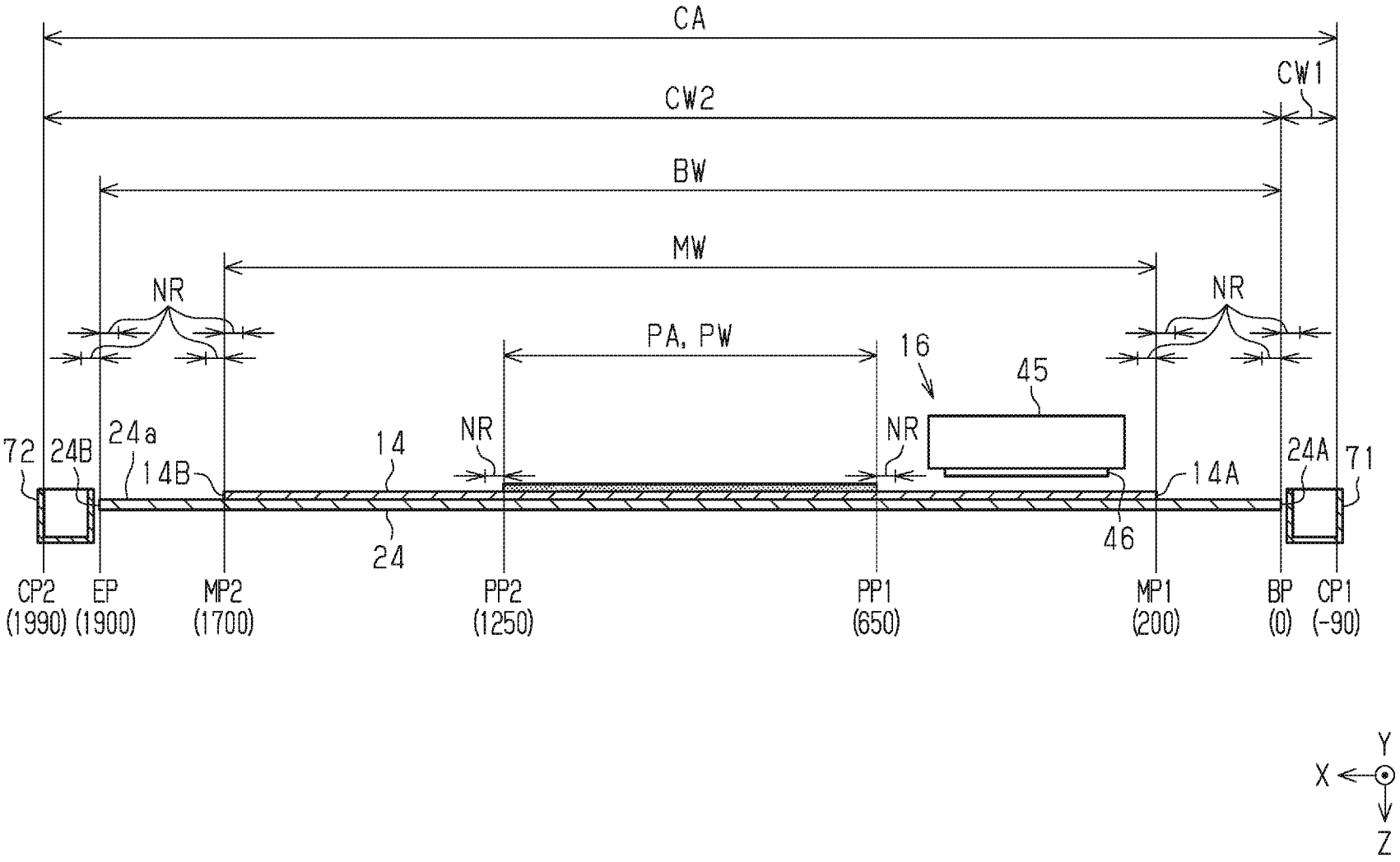
FIG. 4 is a schematic cross-sectional view of the transport belt that transports the medium.

As illustrated in FIG. 4, in the scanning direction X, the position of the first belt end 24A is a reference position BP, the position of the second belt end 24B is a belt end position EP, the position of the first medium end 14A is a first medium end position MP1, and the position of the second medium end 14B is a second medium end position MP2. In the printing area PA, the position of an end closer to the home position is a first printing end position PP1, and the position of an end away from the home position is a second printing end position PP2. In the setting area CA, the position of an end closer to the home position is a first setting end position CP1, and the position of an end away from the home position is the second setting end position CP2.

In the scanning direction X, the size from the first printing end position PP1 to the second printing end position PP2 is a printing width PW. The printing width PW is also the size of the printing area PA. In the scanning direction X, the size from the first medium end position MP1 to the second medium end position MP2 is a medium width MW. In the scanning direction X, the size from the reference position BP to the belt end position EP is a belt width BW. In the scanning direction X, the size from the reference position BP to the first setting end position CP1 is a first setting width CW1, and the size from the reference position BP to the second setting end position CP2 is a second setting width CW2.

The scanning area SA may be provided with a prohibited range NR that is not suitable as the flushing area FA. In the present embodiment, the prohibited range NR is provided by using, as ends, the reference position BP, the first medium end position MP1, the first printing end position PP1, the second printing end position PP2, the second medium end position MP2, and the belt end position EP. In other words, the prohibited range NR includes the end of the transport belt 24, the end of the medium 14, and the end of the printing area PA. The control portion 31 may set, as the prohibited range NR, an area between the first flushing tray 71 and the transport belt 24, an area between the second flushing tray 72 and the transport belt 24, and the printing area PA.

Figure 5:
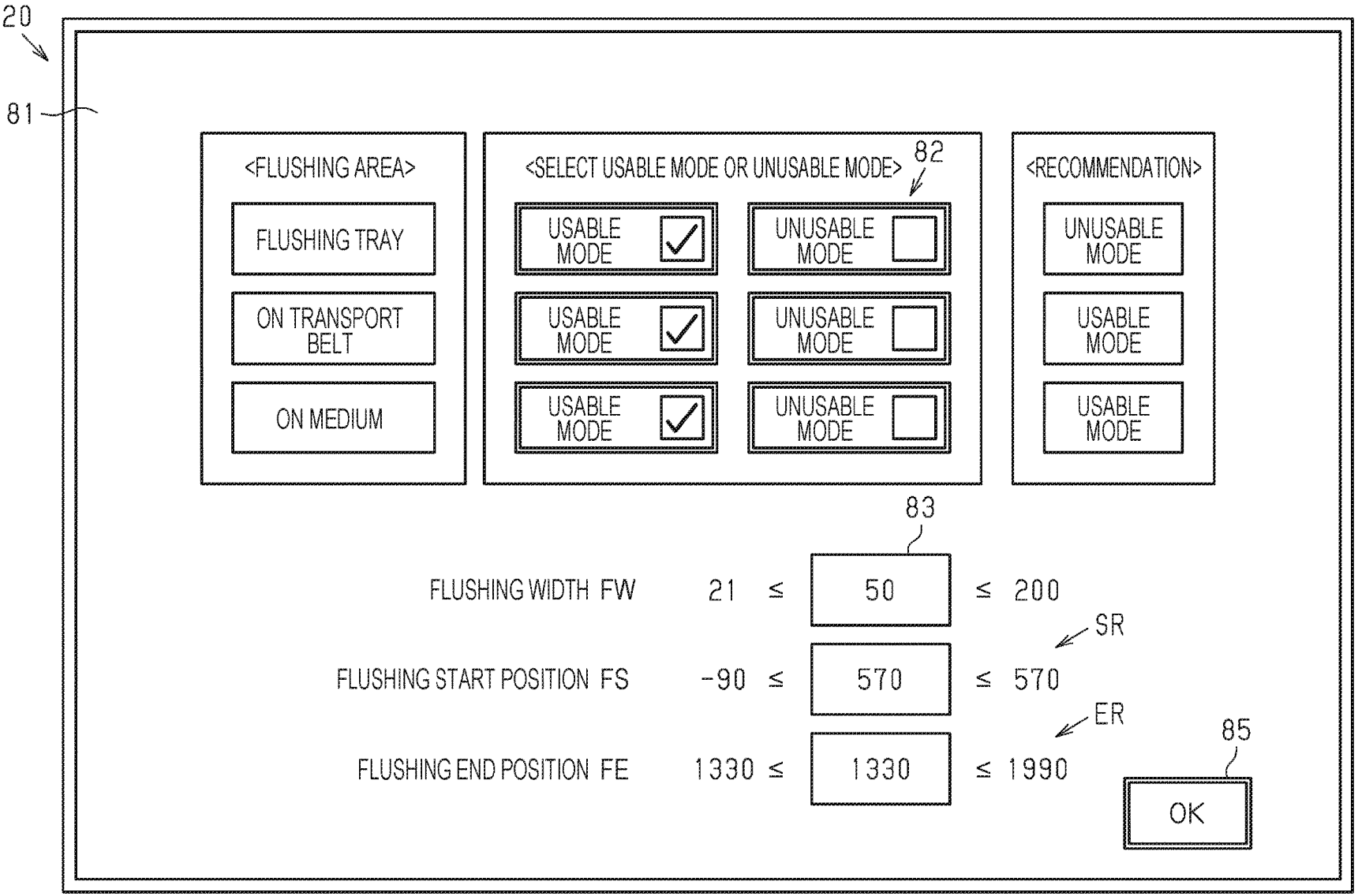
FIG. 5 is a schematic view of a designation portion when a flushing tray, the transport belt, and the medium are selected.

As illustrated in FIG. 5, the designation portion 20 of the present embodiment may include a display portion 81 that displays information. The designation portion 20 may be a touch panel that can directly operate the display portion 81 or may also include an operation portion provided separately from the display portion 81. The designation portion 20 may be provided separately from the housing 12 and may also be electrically coupled to the control portion 31 by wired or wireless communication.

Figure 6:
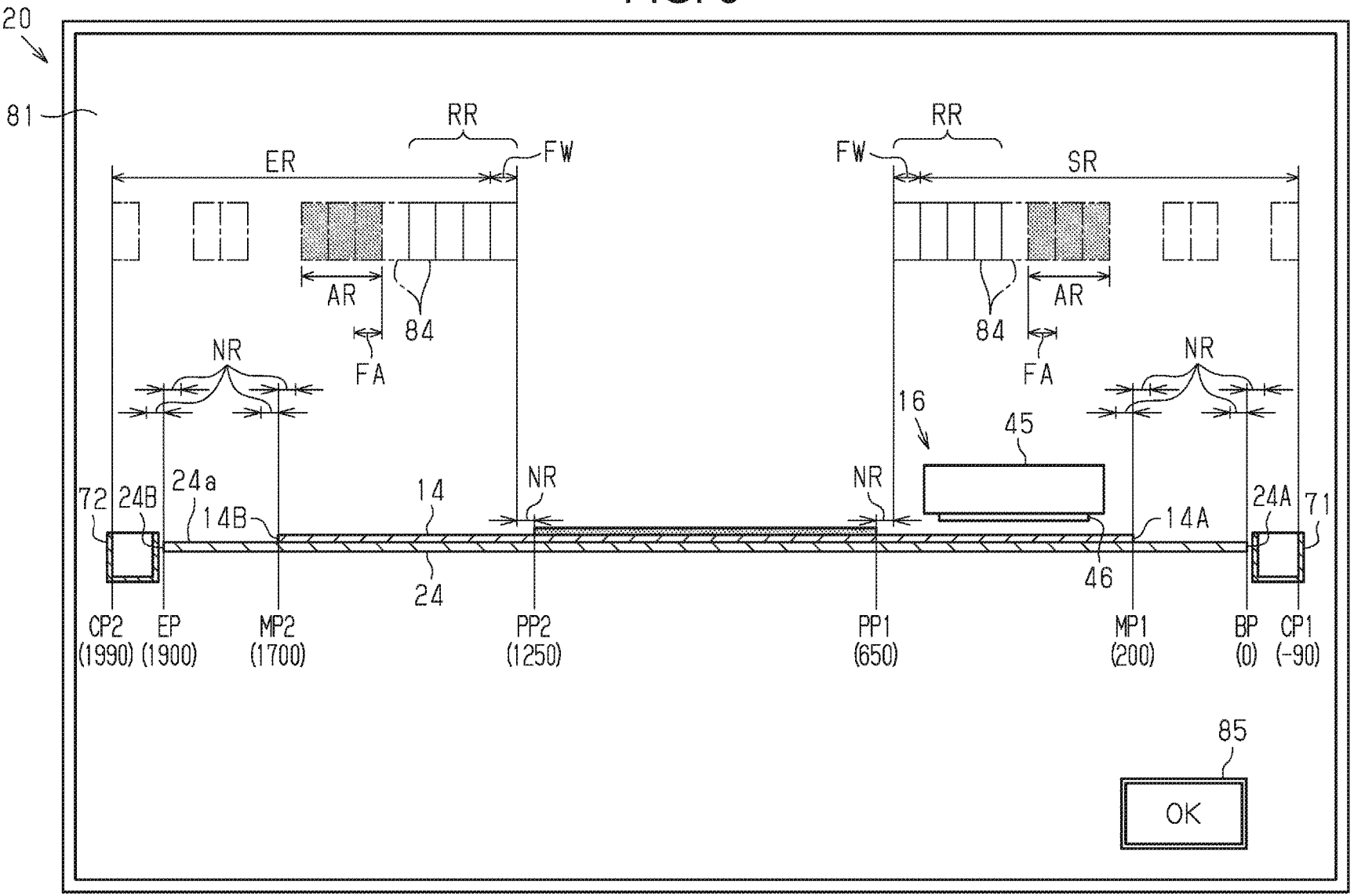
FIG. 6 is a schematic view of the designation portion that displays a designatable range on a display portion.

As illustrated in FIGS. 5 and 6, the designation portion 20 can designate a designation range AR in the scanning area SA by being operated by the operator. In other words, the operator can designate the designation range AR through the designation portion 20. In detail, as illustrated in FIG. 5, the control portion 31 may display, on the display portion 81, a selection button 82 for selecting a member that can set the flushing area FA, and the operator may designate the designation range AR by selecting the selection button 82. As illustrated in FIG. 5, the control portion 31 may display, on the display portion 81, an input portion 83 that can input a numerical value, and the operator may designate the designation range AR by inputting, to the input portion 83, values of a flushing width FW, a flushing start position FS, and a flushing end position FE. As illustrated in FIG. 6, the designation portion 20 may display, on the display portion 81, a selection frame 84 indicating a designatable range, and the operator may designate the designation range AR by selecting the selection frame 84. As illustrated in FIGS. 5 and 6, the display portion 81 may display a confirmation button 85 for confirming the designated designation range AR.

As illustrated in FIG. 6, the control portion 31 may display, on the display portion 81, the designatable range excluding the prohibited range NR that cannot be designated as the designation range AR. For example, the control portion 31 may not display the selection frame 84 including the prohibited range NR. In this case, a range in which the selection frame 84 is displayed becomes the designatable range.

The control portion 31 may display a recommendation range RR that is a range recommended as the flushing area FA. The recommendation range RR is a range recommended as the flushing area FA based on printing specifications on the medium 14. The control portion 31 may set the recommendation range RR based on the medium width MW, the printing width PW, the first printing end position PP1, the second printing end position PP2, the type of liquid, and the like. For example, the control portion 31 may set the recommendation range RR to be narrower when the type of the liquid is likely to thicken than when the type of the liquid is less likely to thicken or may set the recommendation range RR to be wider in the case of the printing specifications in which a large amount of the liquid is ejected onto the medium 14 than in the case of the printing specifications in which a small amount of the liquid is ejected onto the medium 14. The control portion 31 may display the recommendation range RR by displaying the recommendation range RR in a solid-line selection frame 84 and by displaying the selection frame 84 in a range different from the recommendation range RR by an one dot chain line. The control portion 31 may display the designation range AR by changing and displaying the color of the selection frame 84 selected by the operator.

The designation of the designation range AR by the operator may be performed using any one of the selection button 82, the input portion 83, and the selection frame 84 or may be performed in a combination of at least two thereof. For example, the operator may roughly designate the designation range AR by selecting the selection button 82 or may finely designate the designation range AR by inputting a numerical value to the input portion 83. The control portion 31 causes the operator to identify whether or not the designated designation range AR coincides with a range intended by the operator, by displaying the selection frame 84 based on the designation range AR designated by the selection button 82 and the input portion 83. The control portion 31 may display the selection frame 84 indicating the designatable range based on the designation range AR roughly set by the selection button 82, and cause the operator to select the selection frame 84.

An operation of the present embodiment will be described.

As illustrated in FIGS. 5 and 6, when the operator selects the selection button 82, the control portion 31 of the present embodiment displays, on the display portion 81, a start range SR that can be designated as the flushing start position FS and an end range ER that can be designated as the flushing end position FE according to the selected item. At this time, the control portion 31 may input recommendation values of the flushing start position FS and the flushing end position FE into the input portion 83. The recommendation value is a value at which the designation range AR is within the recommendation range RR.

The control portion 31 may display, on the display portion 81, a range which the operator can set as the flushing width FW. A designatable range of the flushing width FW may be set according to whether a simultaneous flushing operation of collectively ejecting the liquid from the plurality of nozzle rows 69 or an individual flushing operation of ejecting the liquid at different timing each for nozzle row 69 is performed or may be set according to the type of used liquid.

When the operator confirms the flushing width FW, the flushing start position FS, and the flushing end position FE by pressing the confirmation button 85 illustrated in FIG. 5, the control portion 31 may determine whether or not the designation range AR is within the recommendation range RR. In this case, a range between the flushing start position FS and the position obtained by adding the flushing width FW to the flushing start position FS and a range between the position obtained by subtracting the flushing width FW from the flushing end position FE and the flushing end position FE become the designation range AR.

When at least a part of the designation range AR is within the recommendation range RR, the control portion 31 sets the flushing area FA such that at least a part of the flushing area FA is located within the recommendation range RR.

When performing the flushing operation, the control portion 31 ejects the liquid from the nozzle 47 to the set flushing area FA.

When the designation range AR is outside the recommendation range RR, the control portion 31 may display the selection frame 84 and cause the operator to identify whether or not the flushing area FA is set outside the recommendation range RR. The control portion 31 may set the flushing area FA to the designation range AR when the result reconfirmed by the operator is the same.

Next, a detailed example of the maintenance method for the liquid ejecting system 11 will be described.

In the drawing, a distance between respective positions in the scanning direction X with reference to the reference position BP is illustrated in parentheses.

As illustrated in FIG. 4, the liquid ejecting system 11 performs printing on the medium 14 disposed in the center of the medium supporting surface 24*a* in the scanning direction X. As an example, the first printing end position PP1 is a position away from the reference position BP by 650 mm, the printing width PW is 600 mm, the medium width MW is 1500 mm, the belt width BW is 1900 mm, the first setting width CW1 is 90 mm, the second setting width CW2 is 1990 mm, and the width of each prohibited range NR is 30 mm.

As illustrated in FIGS. 5 and 6, a case will be described where the operator can use, as the flushing area FA, all the first flushing tray 71, the second flushing tray 72, the transport belt 24, and the medium 14, and the flushing width FW is set to 50 mm.

As illustrated in FIG. 5, the control portion 31 may display, on the display portion 81, the start range SR, the end range ER, and the recommendation value. In detail, the start range SR is not less than the first setting end position CP1 and not more than the first printing end position PP1−the width of the prohibited range NR−the flushing width FW. The end range ER that can be designated as the flushing end position FE is not less than the second printing end position PP2+the width of the prohibited range NR+the flushing width FW and not more than the second setting end position CP2. That is, in the scanning direction X with reference to the reference position BP, the start range SR is not less than −90 mm and not more than 570 mm, and the end range ER is not less than 1330 mm and not more than 1990 mm. The recommendation value of the start range SR is 570 mm which is a maximum value of the start range SR, and the recommendation value of the end range ER is 1330 mm which is a minimum value of the end range ER.

When the operator presses the confirmation button 85 with the recommendation value, the designation range AR is a range between the recommendation value with the recommendation value at an end and the printing area PA, and is equal to the flushing width FW.

The control portion 31 sets the flushing area FA based on the designated designation range AR. That is, the control portion 31 sets, to the flushing area FA, a range from the flushing start position FS input to the input portion 83 to the flushing start position FS+the flushing width FW and a range from the flushing end position FE−the flushing width FW to the flushing end position FE. Therefore, when the operator presses the confirmation button 85 in a state in which the flushing width FW is 50 mm, the flushing start position FS is 570 mm, and the flushing end position FE is 1330 mm, the control portion 31 sets, to the flushing area FA, a range from 570 mm to 620 mm and a range from 1280 mm to 1330 mm with reference to the reference position BP. When performing the flushing operation, the control portion 31 ejects the liquid from the nozzle 47 to the set flushing area FA.

FIG. 6 illustrates a case where the designation range AR deviates from the recommendation range RR. When the operator presses the confirmation button 85 in this state, the control portion 31 sets the flushing area FA at a position closest to the printing area PA in the designation range AR.

Figure 7:
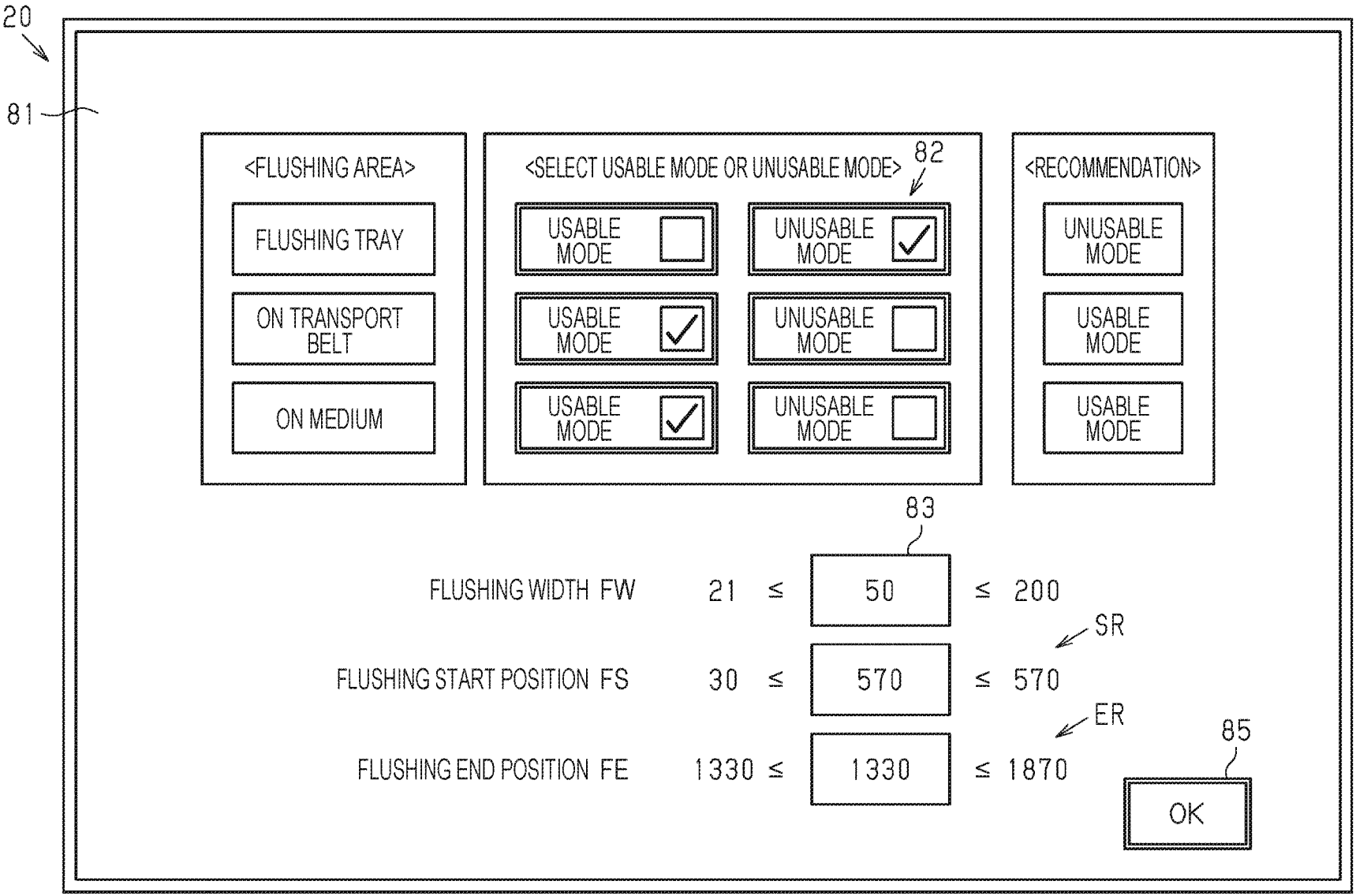
FIG. 7 is a schematic view of the designation portion when the transport belt and the medium are selected.
Figure 8:
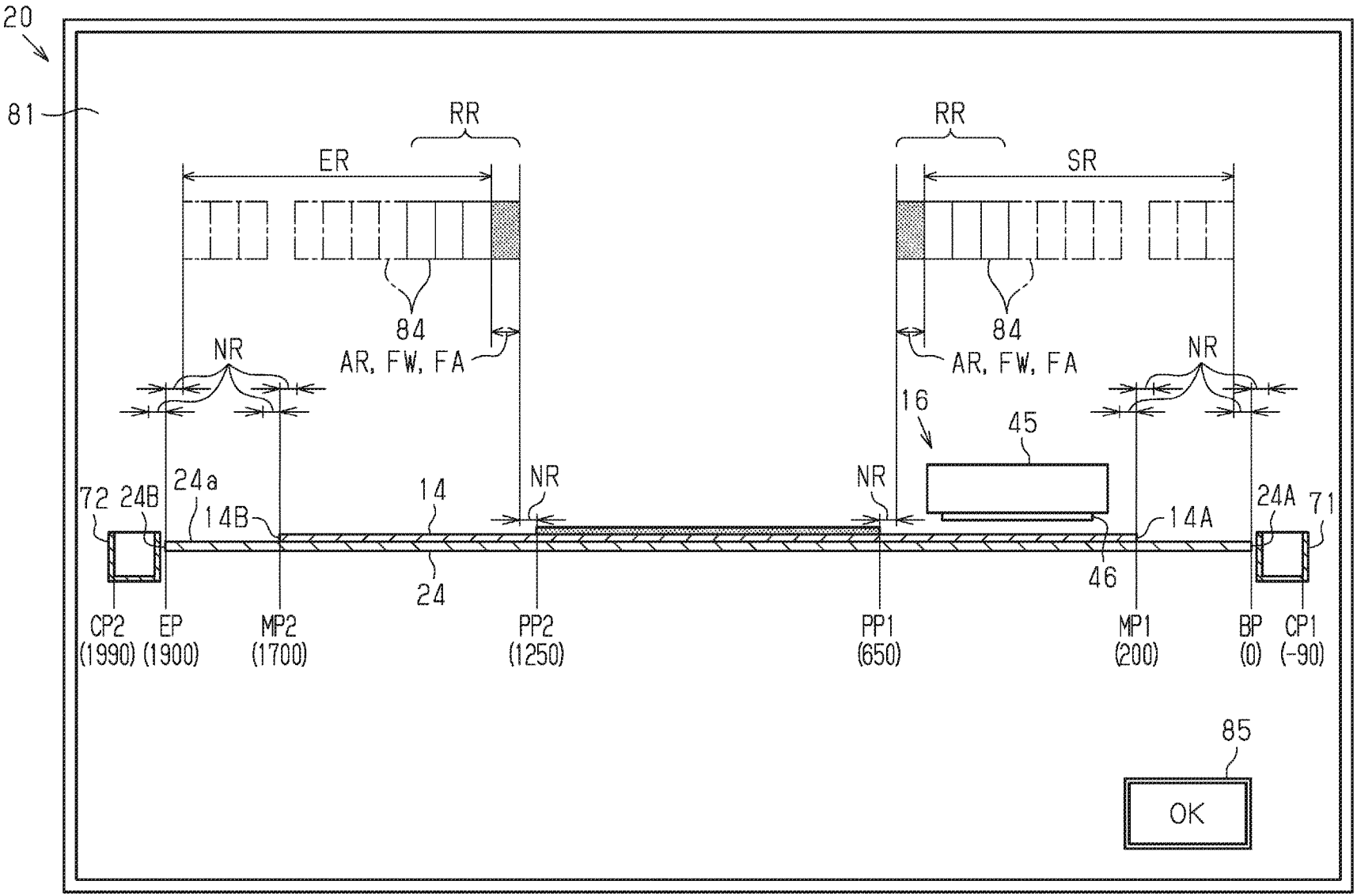
FIG. 8 is a schematic view of the designation portion that displays designatable ranges of the transport belt and the medium on the display portion.

As illustrated in FIGS. 7 and 8, a case will be described in which the operator disables the first flushing tray 71 and the second flushing tray 72 and sets the transport belt 24 and the medium 14 to be usable. This is the recommendation setting for the liquid ejecting system 11. The flushing width FW is set to 50 mm.

In this case, the start range SR is not less than the width of the prohibited range NR and not more than the first printing end position PP1−the width of the prohibited range NR−the flushing width FW. The end range ER is not less than the second printing end position PP2+the width of the prohibited range NR+the flushing width FW and not more than the belt end position EP−the width of the prohibited range NR. That is, in the scanning direction X with reference to the reference position BP, the start range SR is not less than 30 mm and not more than 570 mm, and the end range ER is not less than 1330 mm and not more than 1870 mm.

When the operator presses the confirmation button 85 with the recommendation value, the control portion 31 sets, as the flushing area FA, the range from 570 mm to 620 mm and the range from 1280 mm to 1330 mm with reference to the reference position BP.

Figure 9:
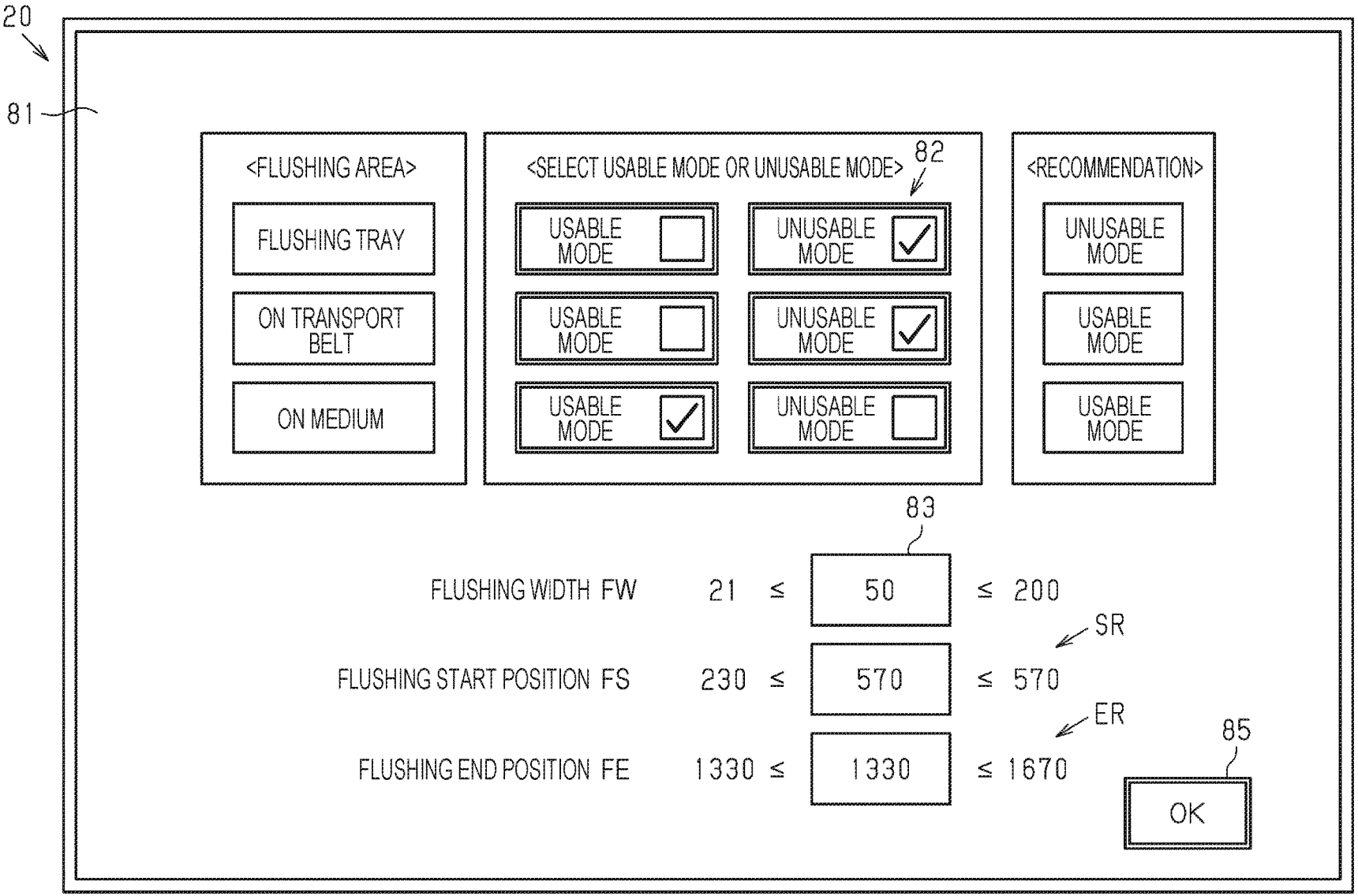
FIG. 9 is a schematic view of the designation portion when the medium is selected.
Figure 10:
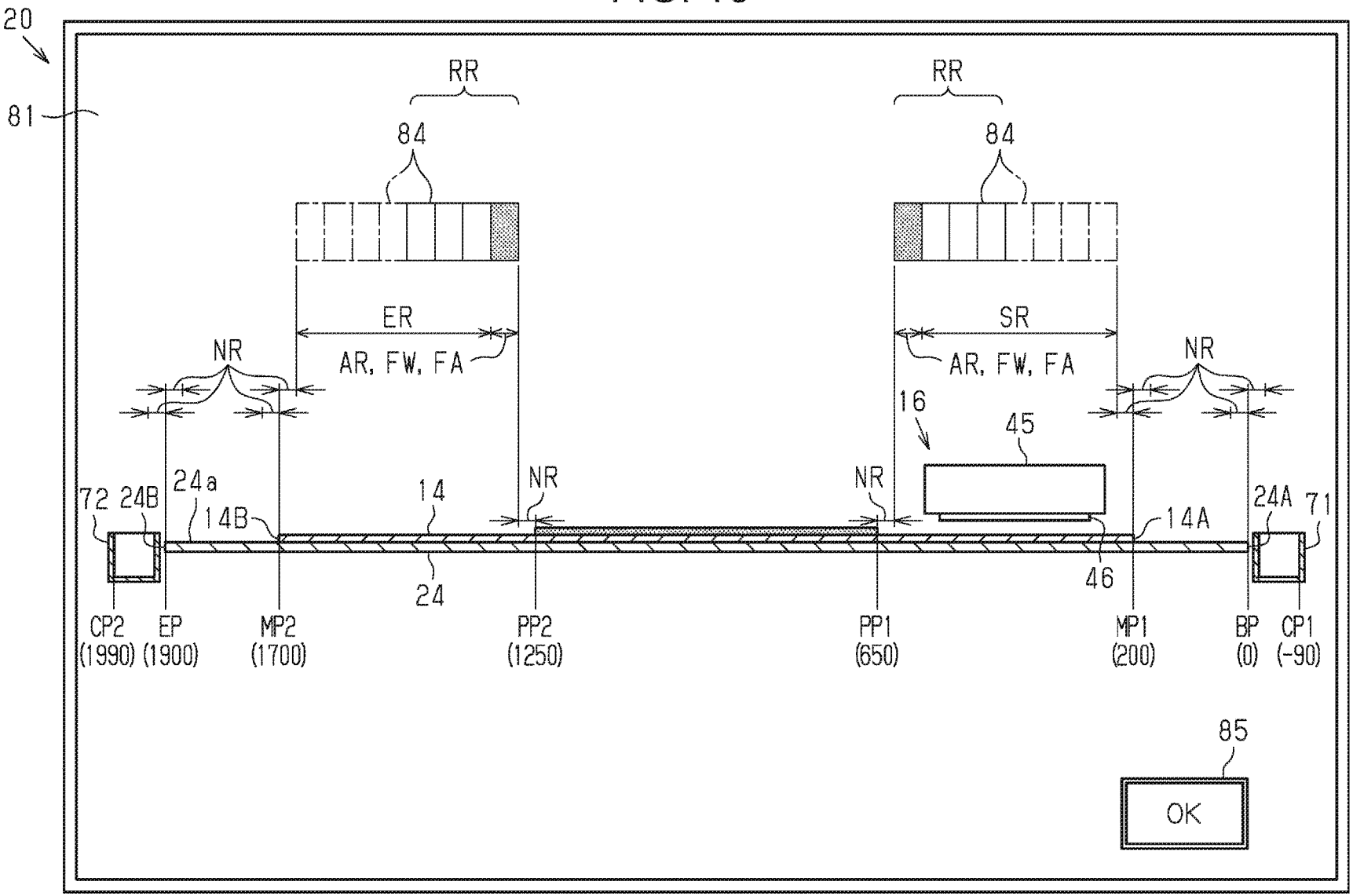
FIG. 10 is a schematic view of the designation portion that displays the designatable range of the medium on the display portion.

As illustrated in FIGS. 9 and 10, a case will be described in which the operator disables the first flushing tray 71, the second flushing tray 72, and the transport belt 24, enables the medium 14, and sets the flushing width FW to 50 mm. When the designated designation range AR is only the medium 14, the control portion 31 sets the flushing area FA to the end of the medium 14 and an area away from the printing area PA on the medium 14.

The start range SR is not less than the first medium end position MP1+the width of the prohibited range NR and not more than the first printing end position PP1−the width of the prohibited range NR−the flushing width FW. The end range ER is not less than the second printing end position PP2+the width of the prohibited range NR+the flushing width FW and not more than the second medium end position MP2−the width of the prohibited range NR. That is, with reference to the reference position BP, the start range SR is not less than 230 mm and not more than 570 mm, and the end range ER is not less than 1330 mm and not more than 1670 mm. The recommendation value for the flushing start position FS is 570 mm, and the recommendation value for the flushing end position FE is 1330 mm.

When the operator presses the confirmation button 85 with the recommendation value, the control portion 31 sets, as the flushing area FA, the range from 570 mm to 620 mm and the range from 1280 mm to 1330 mm with reference to the reference position BP.

Figure 11:
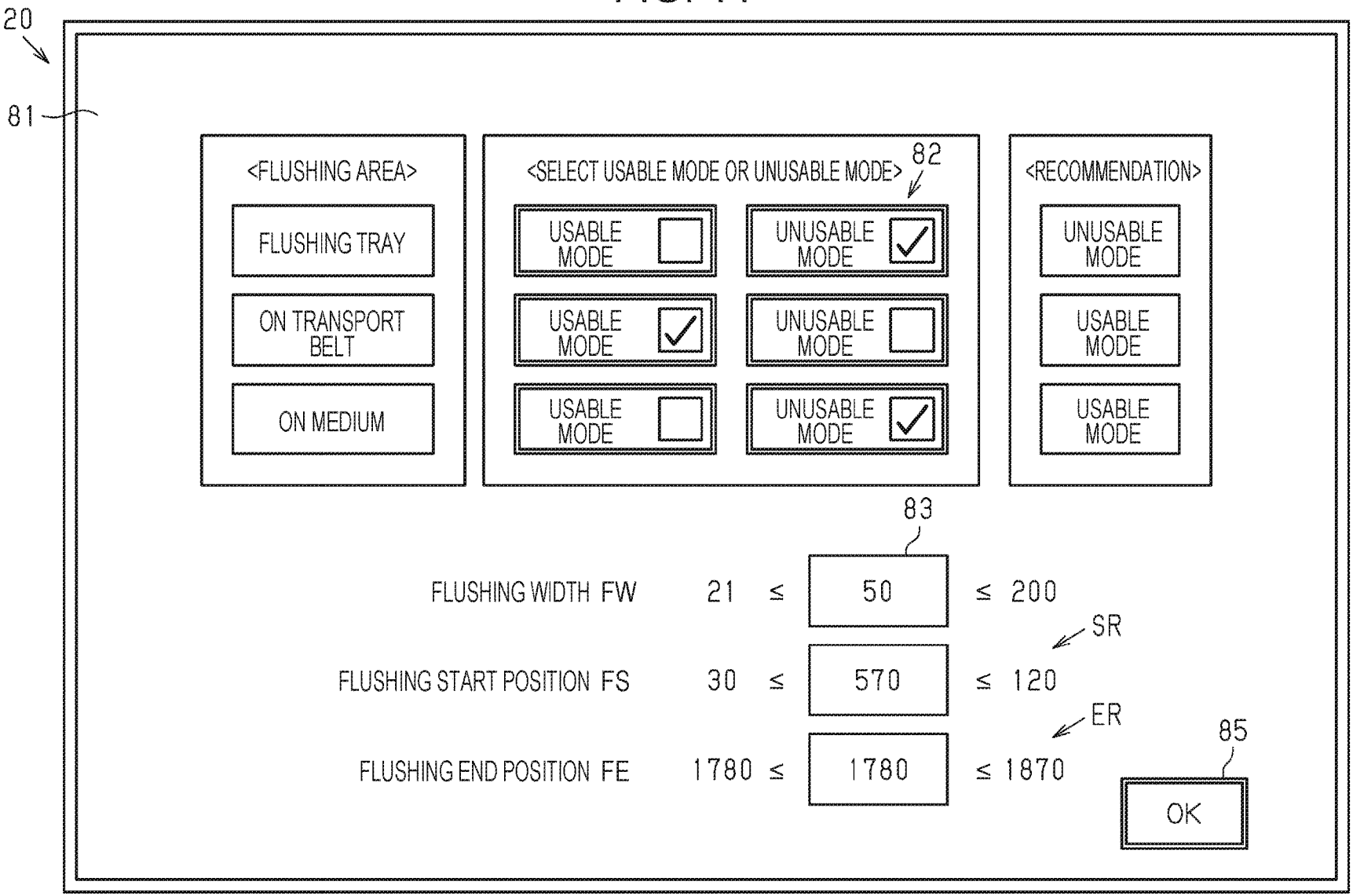
FIG. 11 is a schematic view of the designation portion when the transport belt is selected.
Figure 12:
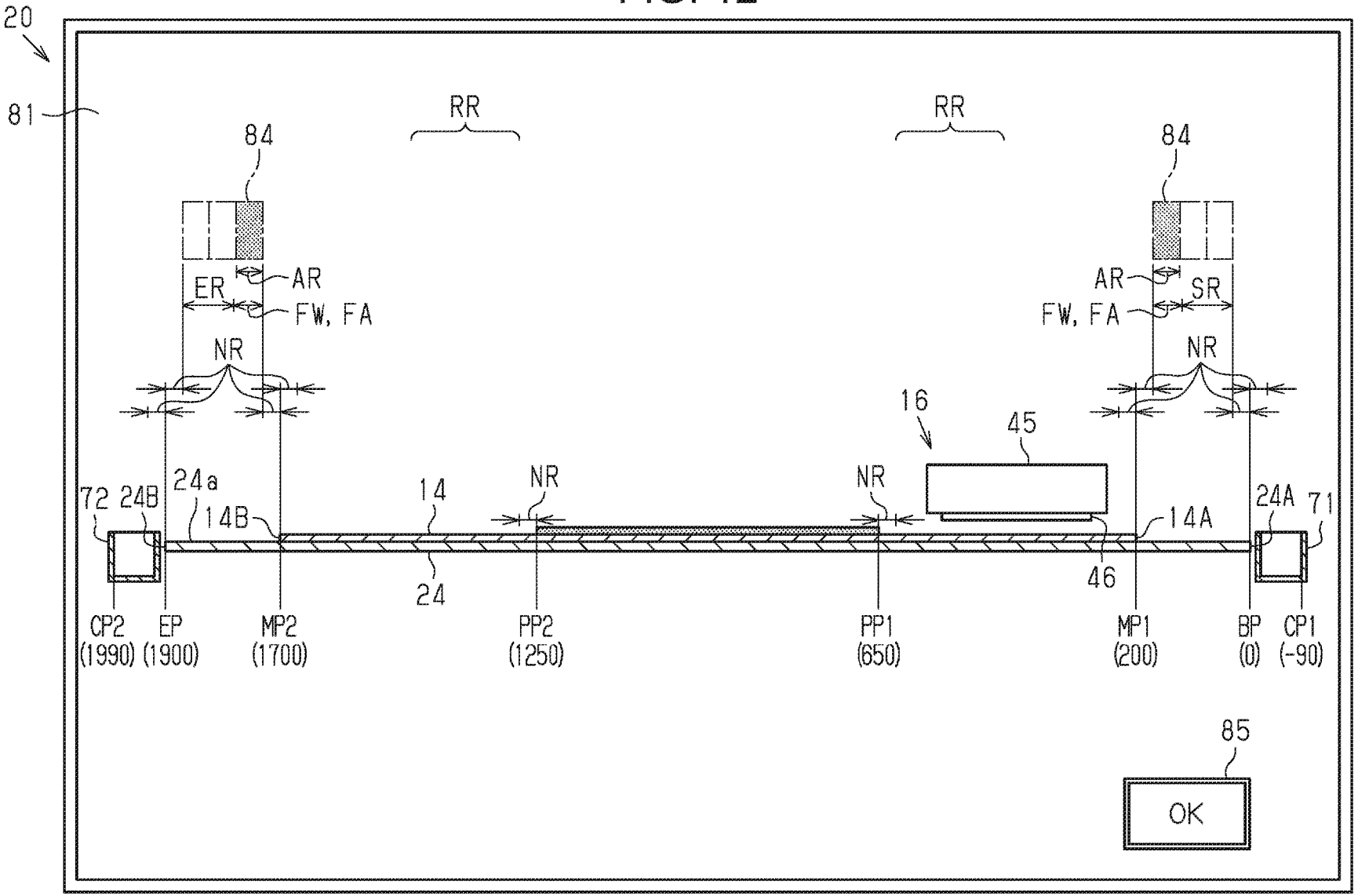
FIG. 12 is a schematic view of the designation portion that displays the designatable range of the transport belt on the display portion.

As illustrated in FIGS. 11 and 12, a case will be described where the operator disables the first flushing tray 71, the second flushing tray 72, and the medium 14, enables the transport belt 24, and sets the flushing width FW to 50 mm. When the designated designation range AR is only the medium supporting surface 24*a*, the control portion 31 sets the flushing area FA to an area away from the medium 14 supported by the medium supporting surface 24*a*. When the designated designation range AR includes the medium supporting surface 24*a*, the control portion 31 sets the flushing area FA to an area away from an end of the medium supporting surface 24*a*. That is, when the prohibited range NR set at ends of the medium 14 and the transport belt 24 is included in the designation range AR, the control portion 31 removes the prohibited range NR and sets the flushing area FA.

In this case, the start range SR is not less than the width of the prohibited range NR and not more than the first medium end position MP1−the width of the prohibited range NR−the flushing width FW. The end range ER is not less than the second medium end position MP2+the width of the prohibited range NR+the flushing width FW and not more than the belt end position EP−the width of the prohibited range NR. That is, with reference to the reference position BP, the start range SR is not less than 30 mm and not more than 120 mm, and the end range ER is not less than 1780 mm and not more than 1870 mm. The recommendation value for the flushing start position FS is 570 mm, and the recommendation value for the flushing end position FE is 1780 mm.

When the operator presses the confirmation button 85 with the recommendation value, the control portion 31 sets, as the flushing area FA, a range from 120 mm to 170 mm and a range from 1730 mm to 1780 mm with reference to the reference position BP.

Figure 13:
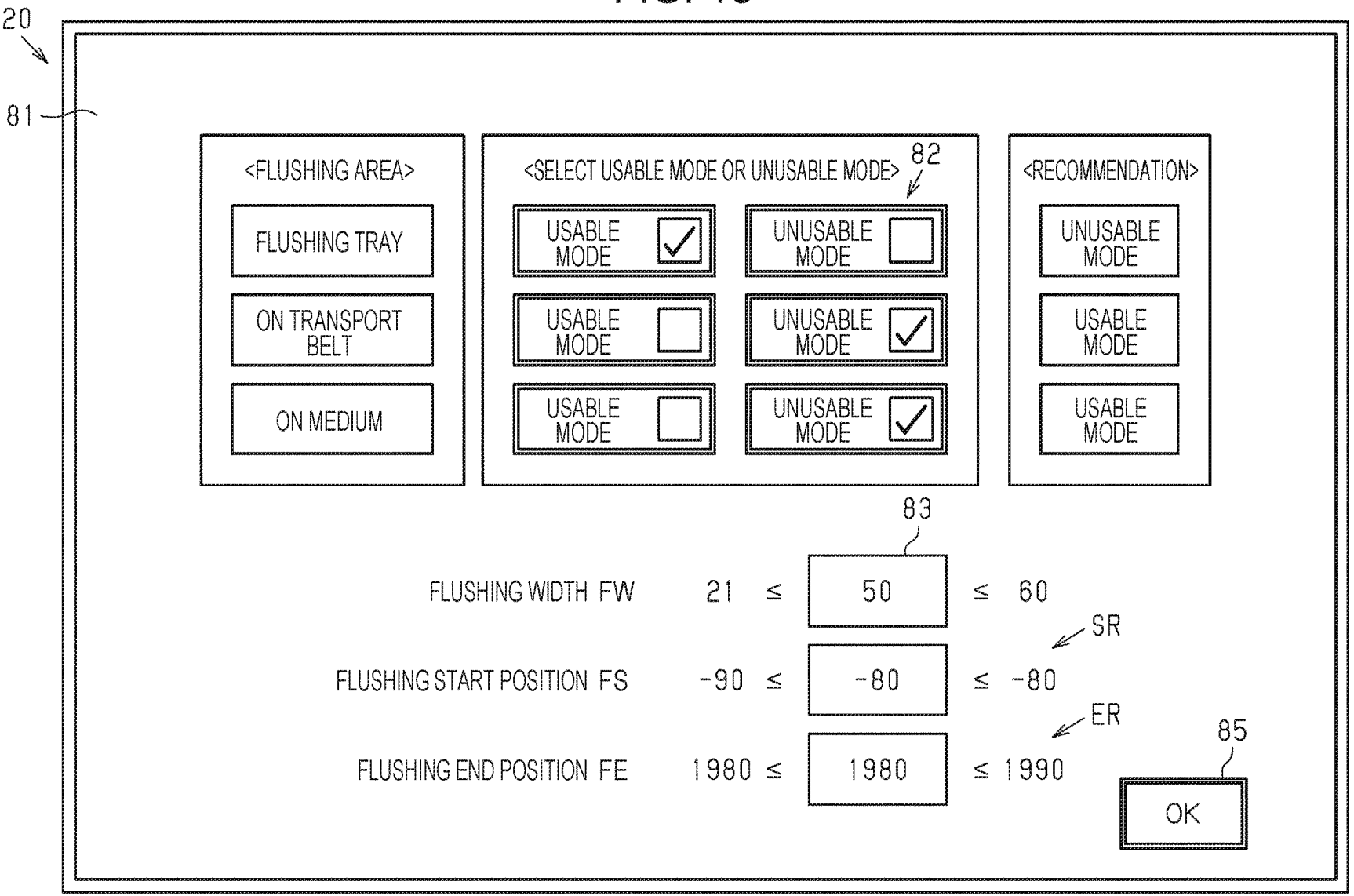
FIG. 13 is a schematic view of the designation portion when the flushing tray is selected.
Figure 14:
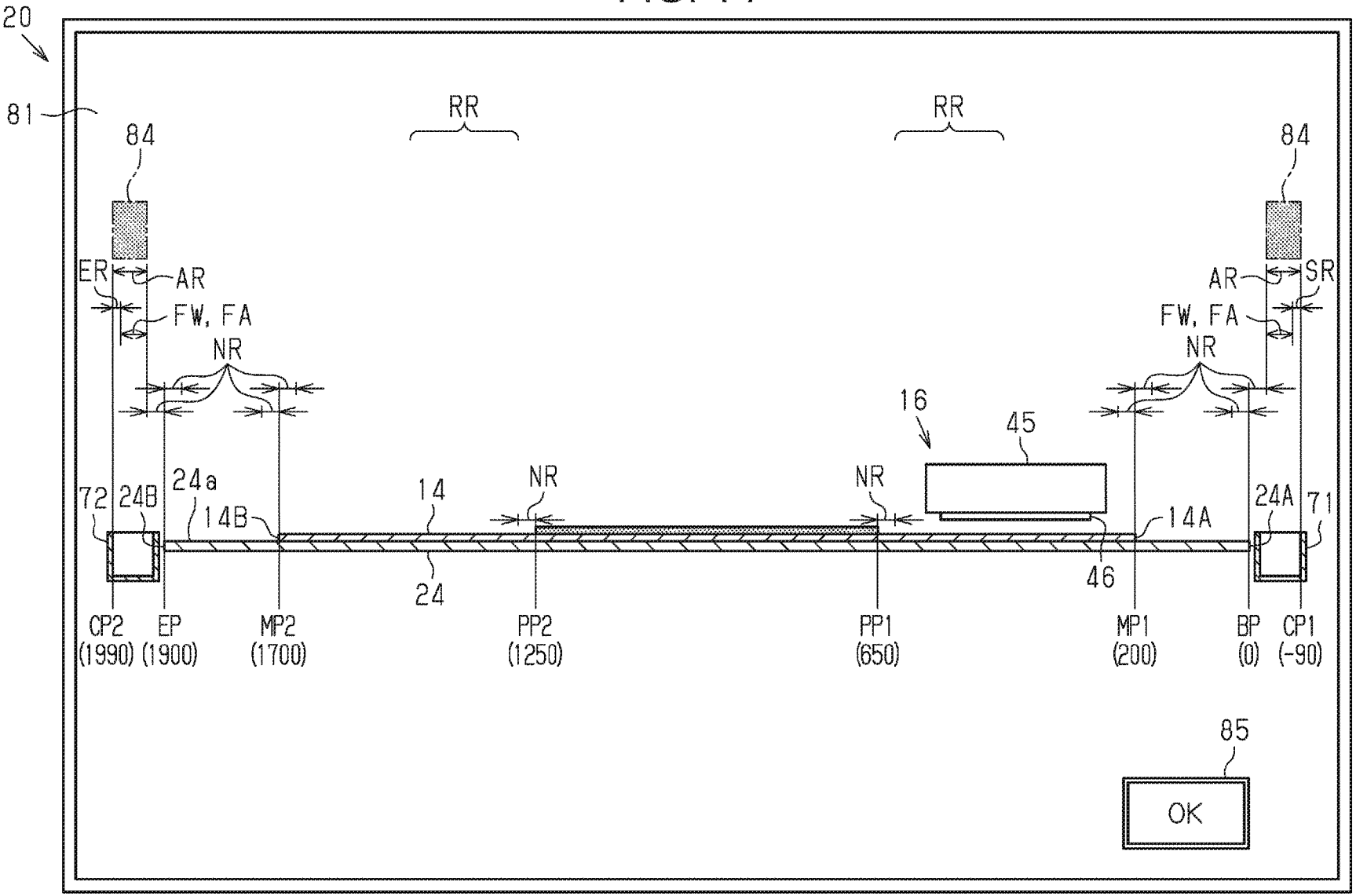
FIG. 14 is a schematic view of the designation portion that displays a designable range of the flushing tray on the display portion.

As illustrated in FIGS. 13 and 14, a case will be described where the operator enables the first flushing tray 71 and the second flushing tray 72, disables the medium 14 and the transport belt 24, and sets the flushing width FW to 50 mm. The control portion 31 sets a maximum value of the flushing width FW to be not more than the width of each of the first flushing tray 71 and the second flushing tray 72.

In this case, the start range SR is not less than the first setting end position CP1 and not more than the reference position BP−the width of the prohibited range NR−the flushing width FW. The end range ER is not less than the belt end position EP+the width of the prohibited range NR+the flushing width FW and is not more than the second setting end position CP2. That is, with reference to the reference position BP, the start range SR is not less than −90 mm and not more than −80 mm and the end range ER is not less than 1980 mm and not less than 1990 mm. The recommendation value for the flushing start position FS is −80 mm, and the recommendation value for the flushing end position FE is 1980 mm.

When the operator presses the confirmation button 85 with the recommendation value, the control portion 31 sets, as the flushing area FA, a range from −80 mm to −30 mm and a range from 1930 mm to 1980 mm with reference to the reference position BP.

The effects of the present embodiment will be described.

(1) The control portion 31 sets the flushing area FA based on the designation range AR designated by the operator. Therefore, it is possible to perform flushing on the flushing area FA that reflects the intention of the operator.

(2) For example, when the liquid ejecting portion 16 ejects the liquid to a position different from the medium supporting surface 24*a* and the medium 14 due to a flushing operation, the inside of the device may be contaminated. In this point, for example, by displaying the designatable range excluding the prohibited range NR that may contaminate the inside of the device, the operator can easily designate the designation range AR excluding the prohibited range NR.

(3) For example, when the liquid ejecting portion 16 ejects the liquid to the end of the transport belt 24 by the flushing operation, there is a concern in that an area around the transport belt 24 may be contaminated by the liquid splashing against the transport belt 24 or the liquid deviating from the transport belt 24. In this point, the prohibited range NR includes the end of the transport belt 24. Therefore, since the display portion 81 displays the designatable range with the end of the transport belt 24 removed, contamination around the transport belt 24 due to the flushing operation can be reduced.

(4) The control portion 31 displays the recommendation range RR on the display portion 81. Therefore, the operator can easily designate the designation range AR in consideration of the recommendation range RR.

(5) The flushing area FA is set to an area away from the medium 14. Therefore, contamination of the medium 14 due to the flushing operation can be reduced.

(6) The flushing area FA is set to an area away from the end of the medium 14 and the printing area PA. Therefore, it is possible to reduce contamination of the medium supporting surface 24*a* by the liquid ejected by the liquid ejecting portion 16 according to the flushing operation.

(7) When the designation range AR is outside the recommendation range RR, the operator identifies whether or not the designation range AR is incorrect. Therefore, when the operator erroneously designates the designation range AR, it is possible to reduce a concern that the operator sets the flushing area FA to an unintended range. When there is no change in the designation range AR even after the confirmation with the operator, the flushing area FA is set to the designation range AR, so that the flushing operation can be performed which prioritizes an operator's intention.

The present embodiment can be modified and implemented as follows. The present embodiment and the following modification examples can be implemented in combination with each other within a technically consistent range.

- The operator may select the selection button 82 to enable the first flushing tray 71, the second flushing tray 72, and the medium 14 and disable the transport belt 24. In this case, the control portion 31 may set the flushing area FA as in the case where only the medium 14 is usable. The operator may enable the first flushing tray 71, the second flushing tray 72, and the transport belt 24, and may disable the medium 14. In this case, the control portion 31 may set the flushing area FA as in the case where only the transport belt 24 is usable.
- When the designation range AR includes the prohibited range NR, the control portion 31 may set the size of the flushing area FA in the scanning direction X to the flushing width FW+the width of the prohibited range NR and may set the flushing area FA across the prohibited range NR. In the flushing operation, the control portion 31 may stop the ejection of the liquid after ejecting the liquid from the end of the flushing area FA to the end of the prohibited range NR, and restart the ejection of the liquid after exceeding the prohibited range NR.
- The number of the flushing areas FA set in the scanning area SA by the control portion 31 may be one.
- When the control portion 31 sets a plurality of the flushing areas FA, intervals from the printing area PA to each flushing area FA may be different in the scanning direction X. The control portion 31 may set the flushing area FA in different members. For example, the control portion 31 may set, on the transport belt 24, the flushing area FA located between the printing area PA and the home position, and may set the other flushing area FA on the medium 14.
- The control portion 31 may set the flushing area FA in the designation range AR without determining whether or not the designated designation range AR is within the recommendation range RR.

When the designated designation range AR is outside the recommendation range RR, the control portion 31 may display a message and request identification from the operator.

Even when the designated designation range AR is only the medium 14, if the size of a blank space of the medium 14 is smaller than the size required to set the flushing area FA, the control portion 31 may set the flushing area FA to an area different from the medium 14. In detail, when the first printing end position PP1–the first medium end position MP1–the width of the prohibited range NR–the width of the prohibited range NR is smaller than the flushing width FW, the control portion 31 sets the flushing area FA to the transport belt 24 or the first flushing tray 71.

Even when the designated designation range AR is only the transport belt 24, if the size from the reference position BP to the first medium end position MP1 is smaller than the size required to set the flushing area FA, the control portion 31 may set the flushing area FA in an area different from that on the transport belt 24. In detail, when the first medium end position MP1–the width of the prohibited range NR–the width of the prohibited range NR is smaller than the flushing width FW, the control portion 31 sets the flushing area FA in the first flushing tray 71.

The width of the designation range AR may be changed according to the type of the medium 14 or the type of the liquid or may be designated by the operator. For example, when the operator sets the width of the designation range AR to 0 mm and enables only the transport belt 24 as the flushing area FA, the control portion 31 may set an area adjacent to the medium 14 as the flushing area FA.

The control portion 31 may set the recommendation range RR based on a printing environment such as temperature and humidity. For example, the control portion 31 may set the recommendation range RR to be narrower when the printing environment is high temperature and low humidity in which the nozzle 47 is likely to be clogged than when the printing environment is low temperature and high humidity in which the nozzle 47 is less likely to be clogged.

The control portion 31 may not display the recommendation range RR. That is, the control portion 31 may display the same selection frame 84 regardless of whether the selection frame 84 is within the recommendation range RR.

The transport portion 15 that transports the medium 14 may include a transport roller pair that transports the medium 14 by rotating while sandwiching the medium 14 and a support portion that supports the medium 14. In this case, the support portion may have a support surface that supports the medium 14 and a recess that is recessed with respect to the support surface, and the control portion 31 may set the flushing area FA on the support portion. As the flushing operation, the control portion 31 may eject the liquid toward a recess located in the flushing area FA.

The control portion 31 may display the designatable range including the prohibited range NR. When the designation range AR designated by the operator includes the prohibited range NR, the control portion 31 may remove the prohibited range NR and set the flushing area FA.

The liquid ejecting system 11 may be a liquid ejecting apparatus that ejects or discharges a liquid other than an ink. Further, a state of the liquid discharged as a minute amount of the droplets from the liquid ejecting apparatus includes a grain state, a teardrop state, and a thread-like tail. The liquid mentioned herein may be any material that can be ejected from the liquid ejecting apparatus. For example, the liquid may be in a state when the material is in a liquid phase state, and includes a fluid-state body such as liquid having high viscosity or low viscosity, sol, gel water, other inorganic solvents, an organic solvent, a solution, liquid resin, liquid metal, and metallic melt. The liquid, which is a state of a matter, includes a solution obtained by dissolving, dispersing, and mixing, in a solvent, particles of a functional material made of a solid such as a pigment or metal particles, in addition to the liquid. Representative examples of the liquid include ink, liquid crystal, and the like as described in the above embodiment. Here, the ink includes various kinds of liquid compositions such as general water-based ink, oil-based ink, gel ink, and hot melt ink. As a specific example of the liquid ejecting apparatus, there is an apparatus that ejects a liquid containing, in a dispersed or dissolved form, a material such as an electrode material and a coloring material used for manufacturing a liquid crystal display, an electroluminescence display, a surface light emitting display, a color filter, or the like. The liquid ejecting apparatus may be an apparatus that ejects a biological organic substance used for manufacturing a biochip, an apparatus that is used as a precision pipette and ejects a liquid as a sample, a textile printing apparatus, a micro dispenser, and the like. The liquid ejecting apparatus may be an apparatus that ejects a lubricating oil to a precision machine such as a watch and a camera using a pinpoint and an apparatus that ejects a transparent resin liquid such as an ultraviolet curable resin onto a substrate to form a micro-hemispherical lens, an optical lens, and the like used for an optical communication element. The liquid ejecting apparatus may be an apparatus that ejects an etching liquid such as acid or alkali to etch a substrate or the like.

Hereinafter, a technical spirit identified from the above-described embodiments and the modification examples and an effects thereof will be described.

A. A liquid ejecting system includes: a transport portion that transports a medium in a transport direction in a state in which the medium is supported on a medium supporting surface; a liquid ejecting portion that performs printing by moving in a scanning direction and ejecting a liquid from a nozzle with respect to the medium supported on the medium supporting surface; a designation portion for an operator to designate a designation range within a scanning area, the scanning area being configured to face the liquid ejecting portion that moves in the scanning direction and to include the medium and the medium supporting surface; and a control portion that sets a flushing area based on the designated designation range and performs a flushing operation of ejecting the liquid from the nozzle to the flushing area as a maintenance operation of the liquid ejecting portion.

According to this configuration, the control portion sets the flushing area based on the designation range designated by the operator. Therefore, the flushing can be performed in the flushing area that reflects the intention of the operator.

B. In the liquid ejecting system, the control portion may display, on a display portion included in the designation portion, a designatable range excluding a prohibited range configured not to be designated as the designation range.

For example, when the liquid ejecting portion ejects a liquid to a position different from the medium supporting surface and the medium due to the flushing operation, the inside of the device may be contaminated. In this respect, according to this configuration, for example, by displaying the designatable range excluding the prohibited range that may contaminate the inside of the device, the operator can easily designate the designation range outside the prohibited range.

C. In the liquid ejecting system, the transport portion may have a transport belt that transports the medium in the transport direction in a state in which the medium is supported on the medium supporting surface, and an end of the transport belt may be included in the prohibited range.

For example, when the liquid ejecting portion ejects the liquid to the end of the transport belt due to the flushing operation, there is a concern in that an area around the transport belt may be contaminated by the liquid splashing against the transport belt or the liquid deviating from the transport belt. In this point, according to this configuration, the prohibited range includes the end of the transport belt. Therefore, since the display portion displays the designatable range with the end of the transport belt removed, contamination around the transport belt due to the flushing operation can be reduced.

D. In the liquid ejecting system, the control portion may display, on a display portion included in the designation portion, a recommendation range recommended as the flushing area.

According to this configuration, the control portion displays the recommendation range on the display portion. Therefore, the operator can easily designate the designation range in consideration of the recommendation range.

E. A maintenance method for a liquid ejecting system including: a transport portion that transports a medium in a transport direction in a state in which the medium is supported on a medium supporting surface; a liquid ejecting portion that moves in a scanning direction and ejects a liquid from a nozzle with respect to the medium supported on the medium supporting surface; and a designation portion for an operator to designate a designation range within a scanning area, the scanning area being configured to face the liquid ejecting portion that moves in the scanning direction and to include the medium and the medium supporting surface, the method including: setting a flushing area based on the designated designation range; and performing a flushing operation of ejecting the liquid from the nozzle to the flushing area as a maintenance operation of the liquid ejecting portion may be provided. According to this method, the same effect as the liquid ejecting system can be obtained.

F. In the maintenance method of the liquid ejecting system, when the designated designation range includes the medium supporting surface, the flushing area may be set to an area spaced apart from an end of the medium supporting surface. According to this method, the same effect as the liquid ejecting system can be obtained.

G. In the maintenance method of the liquid ejecting system, when the designated designation range is only the medium supporting surface, the flushing area may be set to an area spaced apart from the medium supported by the medium supporting surface. According to this method, the flushing area is set in the area away from the medium. Therefore, the contamination of the medium due to the flushing operation can be reduced.

H. In the liquid ejecting system maintenance method, when the designated designation range is only the medium, the flushing area may be set to an area spaced apart from an end of the medium and a printing area on the medium.

According to this method, the flushing area is set in an area away from the end of the medium and the printing area. Therefore, it is possible to reduce the contamination of the medium supporting surface due to the liquid ejected by the liquid ejecting portion according to the flushing operation.

I. In the liquid ejecting system maintenance method, when the designated designation range is outside a recommendation range recommended as the flushing area based on printing specifications on the medium, and a result re-identified by an operator is the same, the flushing area may be set to the designation range.

According to this method, when the designation range is outside the recommendation range, the operator identifies whether or not the designation range is incorrect. Therefore, when the operator incorrectly designates the designation range, it is possible to reduce a risk that the operator sets the flushing area to an unintended range. When there is no change in the designation range even after the identification by the operator, the flushing area is set to the designation range, so that the flushing operation can be performed which prioritizes an operator's intention.

What is claimed is:

1. A liquid ejecting system comprising:

a transporter that transports a medium in a transport direction in a state in which the medium is supported on a medium supporting surface;

a liquid ejector that performs printing by moving in a scanning direction and ejecting a liquid from a nozzle with respect to the medium supported on the medium supporting surface;

a designator configured for an operator to designate a designation range within a scanning area, the scanning area being configured to face the liquid ejector that moves in the scanning direction and to include the medium and the medium supporting surface, the designator further configured to allow the operator to individually designate whether at least a medium and a medium support surface are usable or unusable as a flushing area; and a controller that sets the flushing area based on the designations received at the designator and performs a flushing operation of ejecting the liquid from the nozzle to the flushing area as a maintenance operation of the liquid ejector.

2. The liquid ejecting system according to claim 1, wherein the controller displays, on a display portion included in the designator, a designatable range excluding a prohibited range configured not to be designated as the designation range.

3. The liquid ejecting system according to claim 2, wherein the transporter has a transport belt that transports the medium in the transport direction in a state in which the medium is supported on the medium supporting surface, and an end of the transport belt is included in the prohibited range.

4. The liquid ejecting system according to claim 1, wherein the controller displays, on a display portion included in the designator, a recommendation range recommended as the flushing area.

5. The liquid ejecting system according to claim 1, wherein the designator further configured to allow the operator to designate whether a flushing tray is usable or unusable as the flushing area.

6. A maintenance method for a liquid ejecting system including:

a transporter that transports a medium in a transport direction in a state in which the medium is supported on a medium supporting surface;

a liquid ejector that moves in a scanning direction and ejects a liquid from a nozzle with respect to the medium supported on the medium supporting surface; and a designator for an operator to designate a designation range within a scanning area, the scanning area being configured to face the liquid ejector that moves in the scanning direction and to include the medium and the medium supporting surface, the method comprising:

setting a flushing area based on the designated designation range; and performing a flushing operation of ejecting the liquid from the nozzle to the flushing area as a maintenance operation of the liquid ejector, wherein when the designated designation range includes the medium supporting surface, the flushing area is set to an area spaced apart from an end of the medium supporting surface.

7. The maintenance method for a liquid ejecting system according to claim 6, wherein when the designated designation range is only the medium, the flushing area is set to an area spaced apart from an end of the medium and a printing area on the medium.

8. The maintenance method for a liquid ejecting system according to claim 6, wherein when the designated designation range is only the medium supporting surface, the flushing area is set to an area spaced apart from the medium supported by the medium supporting surface.

9. A maintenance method for a liquid ejecting system, including:

a transporter that transports a medium in a transport direction in a state in which the medium is supported on a medium supporting surface;

a liquid ejector that moves in a scanning direction and ejects a liquid from a nozzle with respect to the medium supported on the medium supporting surface; and a designator for an operator to designate a designation range within a scanning area, the scanning area being configured to face the liquid ejector that moves in the scanning direction and to include the medium and the medium supporting surface, the method comprising:

setting a flushing area based on the designated designation range; and performing a flushing operation of ejecting the liquid from the nozzle to the flushing area as a maintenance operation of the liquid ejector wherein when the designated designation range is outside a recommendation range recommended as the flushing area based on printing specifications on the medium, and a result re-identified by an operator is the same, the flushing area is set to the designation range.

10. The maintenance method for a liquid ejecting system according to claim 9, wherein when the designated designation range is only the medium, the flushing area is set to an area spaced apart from an end of the medium and a printing area on the medium.

* * * * *